US008602549B2

(12) United States Patent
Saito et al.

(10) Patent No.: US 8,602,549 B2
(45) Date of Patent: Dec. 10, 2013

(54) TRANSPORTING ROLLER AND RECORDING APPARATUS

(75) Inventors: Koichi Saito, Nagano-ken (JP); Katsunori Ono, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 133 days.

(21) Appl. No.: 13/311,981

(22) Filed: Dec. 6, 2011

(65) Prior Publication Data

US 2012/0140012 A1 Jun. 7, 2012

(30) Foreign Application Priority Data

Dec. 7, 2010 (JP) ..... 2010-272278

(51) Int. Cl.
*B41J 2/01* (2006.01)
*B65H 5/06* (2006.01)

(52) U.S. Cl.
USPC ..... 347/104; 271/275

(58) Field of Classification Search
USPC ..... 347/88, 101–104; 271/275, 8.1, 264; 399/388; 400/578; 101/228
IPC ..... B41J 2/01; B65H 5/06
See application file for complete search history.

(56) References Cited

U.S. PATENT DOCUMENTS

| | | | | |
|---|---|---|---|---|
| 5,829,354 | A * | 11/1998 | Buckley | 101/483 |
| 7,610,938 | B2 | 11/2009 | Yanokura et al. | |
| 2010/0206191 | A1* | 8/2010 | Saito et al. | 101/216 |
| 2010/0206687 | A1* | 8/2010 | Saito et al. | 193/37 |
| 2010/0206698 | A1* | 8/2010 | Saito et al. | 198/789 |
| 2010/0209168 | A1* | 8/2010 | Saito et al. | 400/578 |
| 2010/0209170 | A1* | 8/2010 | Saito et al. | 400/636 |

FOREIGN PATENT DOCUMENTS

| | | | |
|---|---|---|---|
| JP | 2003-148504 | A | 5/2003 |
| JP | 2006-289496 | A | 10/2006 |

* cited by examiner

*Primary Examiner* — Manish S Shah
*Assistant Examiner* — Roger W Pisha, II

(57) ABSTRACT

A transporting roller is formed of a metal plate formed into a cylindrical shape so that a pair of end surfaces oppose each other and having a joint line extending in the axial direction formed by the pair of the end surfaces including: a high friction layer formed on a surface of the roller and configured to come into contact with a transported medium; an opening provided out of the high friction layer; and a gear member disposed so that an inner peripheral surface is located on the opening.

4 Claims, 17 Drawing Sheets

30
40
39
35
15
41
43
32
33
45, 27
65
80
28
25
CONT

TRANSPORTING ROLLER AND RECORDING APPARATUS

CROSS-REFERENCE TO RELATED APPLICATION

The entire disclosure of Japanese Patent Application No: 2010-272278, filed Dec. 7, 2010 is expressly incorporated by reference herein.

BACKGROUND

1. Technical Field

The present invention relates to a transporting roller and a recording apparatus.

2. Related Art

In the related art, a recording apparatus configured to record information on a sheet-type recording medium is used, and the recording apparatus includes a transporting device configured to transport the recording medium. The transporting device includes a transporting roller configured to transport the recording medium by rotating, and a driven roller configured to be urged by the transporting roller and come into abutment therewith, and is configured to transport the recording medium by nipping the same therebetween. A solid rod-shaped member is generally used as the transporting roller. In contrast, the solid material has a problem of a heavier weight and a higher cost. In JP-A-2006-289496, a technology to form a metal plate into a cylindrical shape by a bending process is described.

In a cylindrical shaft described in JP-A-2006-289496, when forming the metal plate into a cylindrical shape by the bending step, end surfaces of the metal plate are brought into abutment with each other. Therefore, a joint line is formed between a pair of end surfaces of the metal plate over the entire length of the cylindrical shaft.

Incidentally, the transporting roller includes a gear member to be coupled to a drive unit attached to an end thereof. Such a gear member, being required to have a predetermined resistance against a torque, needs to be securely fixed to a roller body. As s method of fixing the gear member to the roller body, press-fitting of the gear member into the roller body is contemplated. However, when the drive gear is press-fitted into the roller body formed of the cylindrical shaft described in JP-A-2006-289496, there is a risk of plastic deformation of the cylindrical shaft caused by a force applied at the time of the press-fitting. Accordingly, there may arise a problem in that a feeding accuracy of the recording medium is lowered.

SUMMARY

An advantage of some aspects of the invention is that a transporting roller and a recording apparatus capable of transporting a recording medium with high degree of accuracy even when a gear member is assembled by press-fitting are provided.

According to a first aspect of the invention, there is provided a recording and transporting roller formed of a metal plate formed into a cylindrical shape so that a pair of opposed end surfaces oppose each other and having a joint line extending in the axial direction formed by the pair of the end surfaces including: a high friction layer formed on a surface of the transporting roller and configured to come into contact with a transported medium; an opening provided out of the high friction layer; and a gear member disposed so that an inner peripheral surface is located on the opening.

According to the transporting roller in the invention, the inner peripheral surface of the gear member is located on the opening provided out of the high frictional layer, so that the rotation of the gear member in the direction of radius of the roller is restricted and the position in the direction of the length of the roller is fixed. In other words, the gear member is desirably held by the roller by the opening and is provided with a predetermined resistance against a torque. Therefore, even when a press-fitting force is reduced when mounting the gear member on the roller by press-fitting, the resistance of the gear member against the torque can be supplemented by the opening. Therefore, even when the gear member is assembled to the roller having a cylindrical shape lower in rigidity than the solid shaft and having the joint line with the press-fitting force which does not cause any plastic deformation, the roller having a predetermined feeding accuracy can be provided.

Preferably, the opening is an opening generated between a depression formed on the side of one of the pair of the end surfaces of the metal plate which form the joint line and a projection formed on the side of the other end surface and configured to be engaged with the depression.

In this configuration, by the engagement between the depression and the projection, a joint strength of the joint line of the roller can be improved. Also, since the opening generated between the depression and the projection is used, machining of the metal plate which constitutes the roller can be simplified.

Preferably, the gear member is engaged with the opening generated between the depression and the projection. Since the gear member is engaged with the opening generated between the depression and the projection, the gear member is locked with respect to the roller and is stabilized.

Preferably, part of the projection projects radially outward from an outer peripheral surface of the roller.

In this configuration, the projection projecting radially outward from an outer peripheral surface of the roller can be engaged reliably with the inner peripheral surface of the gear member.

Preferably, the direction of extension of the projection matches the direction of rotation of the roller during the transporting operation.

In this configuration, when the roller rotates at the time of transporting operation, the projection reliably engages the inner peripheral surface of the gear member, whereby the gear member can be prevented from rotating with respect to the roller. Therefore, the gear member is capable of reliably transmitting a predetermined drive force, so that a feeding accuracy with high degree of reliability can be obtained.

According to a second aspect of the invention, there is provided a recording apparatus configured to perform recording on a recording medium including: a tray configured to place the recording medium; a recording unit provided on the downstream side in the direction of transport of the recording medium with respect to the tray and configured to perform recording on the recording medium; and a transporting roller configured to transport the recording medium, wherein the transporting roller includes: a high friction layer formed on a surface of the transporting roller and configured to come into contact with a transported medium; an opening provided out of the high friction layer; and a gear member disposed so that an inner peripheral surface is located on the opening.

According to the recording apparatus in the invention, since the gear member is provided with the transporting roller in which the gear member is desirably held by the roller, the recording apparatus by itself has high degree of reliability provided with a high degree of feeding accuracy.

Preferably, the opening is an opening generated between a depression formed on the side of one of the pair of the end surfaces of the metal plate which form the joint line and a projection formed on the side of the other end surface and configured to be engaged with the depression.

In this configuration, by the engagement between the depression and the projection, a joint strength of the joint line of the roller can be improved, so that the recording apparatus can be used for a long time. Also, since the opening generated between the depression and the projection is used, machining of the metal plate which constitutes the roller can be simplified, so that a simple configuration of the recording apparatus is achieved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
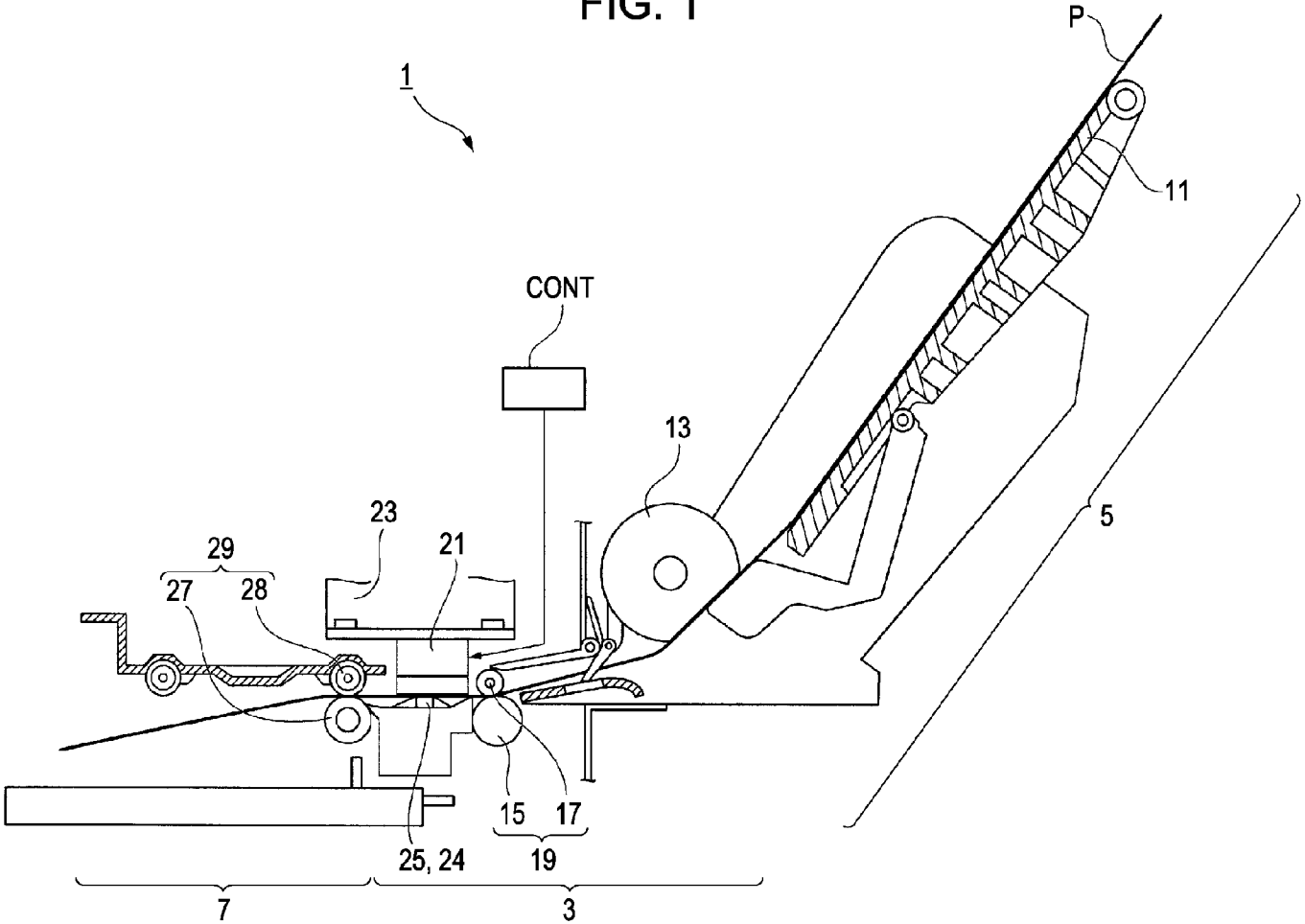
FIG. 1 is a cross-sectional side view of an ink jet printer according to an embodiment of the invention.

Referring now to the drawings, embodiments of the invention will be described.

Drawings used in the description given below are schematic drawings in which reduction of scales of respective members are changed as needed in order to illustrate the respective members in recognizable sizes.

FIG. 1 is a cross-sectional side view of an ink jet printer according to an embodiment of the invention.

Figures 2A, 2B:
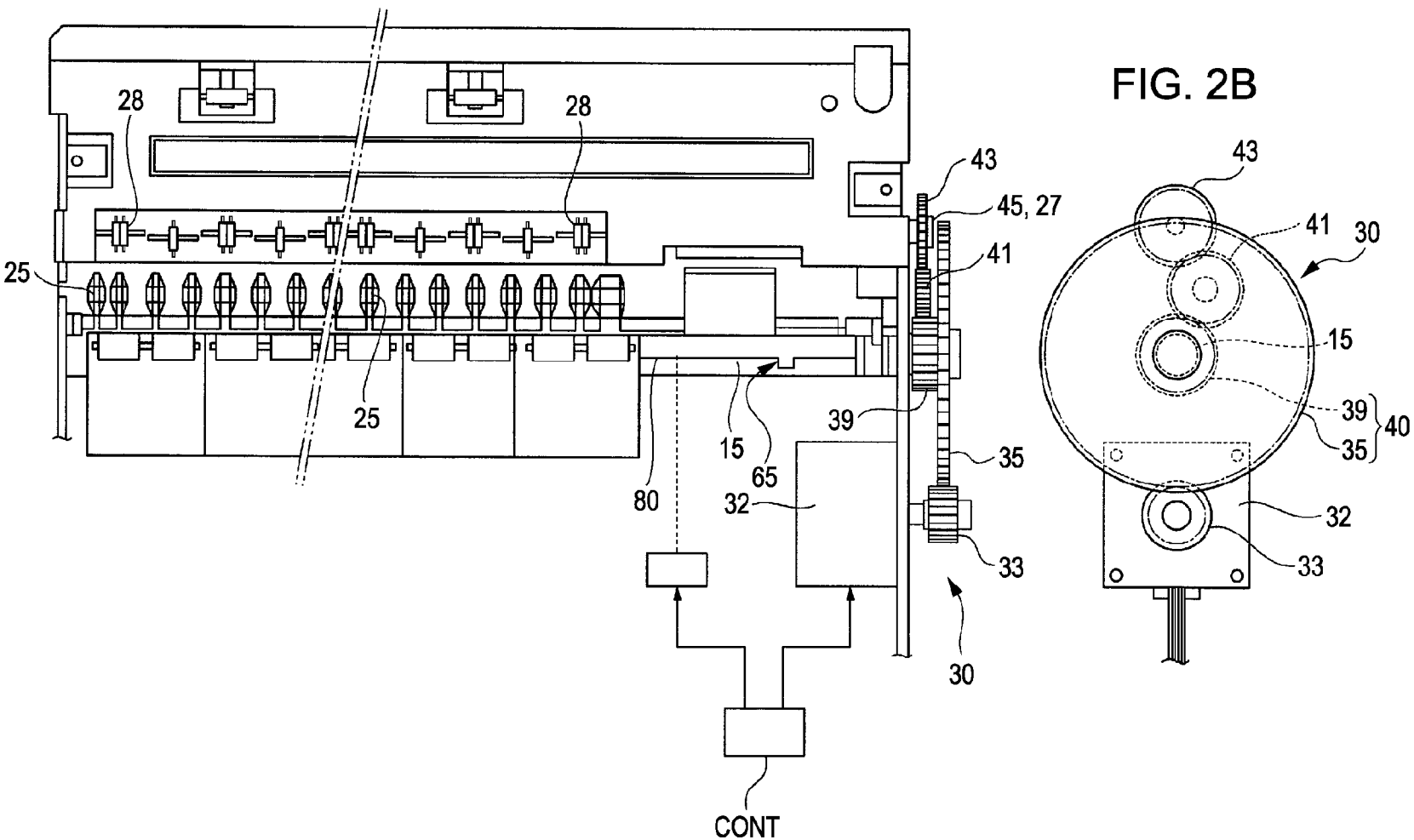
FIG. 2A is a plan view showing a transporting unit of the ink jet printer.
FIG. 2B is a side view showing a drive system of the transporting unit.

FIG. 2A is a plan view showing a transporting unit of the ink jet printer, and FIG. 2B is a side view showing a drive system of the transporting unit.

As shown in FIG. 1, an ink jet printer (a recording apparatus) 1 includes a printer body 3, a paper feed unit 5 provided on the printer body 3 on the upper rear side, and a paper discharge unit 7 provided in front of the printer body 3.

The paper feed unit 5 is provided with a paper feed tray 11, and a plurality of recording sheets (medium, recording medium, transported medium) P are stacked on the paper feed tray 11. The recording sheets P here include normal sheets, coated sheets, OHP (overhead projector) sheets, glossy sheets, and glossy films. Hereinafter, the paper feed tray 11 side of a transporting route of the recording sheet P is referred to as an upstream side, and the paper discharge unit 7 side thereof is referred to as a downstream side. On the downstream side of the paper feed tray 11, a paper feed roller 13 is provided.

The paper feed roller 13 is configured to pinch the recording sheet P located at an uppermost position of the paper feed tray 11 with an opposed separation pad (not illustrated), and feed the same to the downstream side. On the downstream side of the paper feed roller 13, a transporting roller mechanism 19 is provided.

The transporting roller mechanism 19 is provided with a transporting roller 15 arranged on the downstream side, and a driven roller 17 arranged on the upstream side.

The transporting roller 15 is provided so as to pinch the recording sheet P with the driven roller 17, and be driven to rotate by a drive unit 30 shown in FIGS. 2A and 2B. Accordingly, the transporting roller 15 is capable of transporting the recording sheet P to a recording head (a recording unit) 21 arranged on the downstream side by a precise and accurate transporting (paper feeding) action in association with a transporting and recording process.

The recording head 21 is held by a carriage 23, and the carriage 23 is configured to move reciprocally in the direction orthogonal to a paper feeding direction (the direction of transporting the recording sheet P). A printing process (a recording process) by the recording head is controlled by a control unit CONT. A platen 24 is disposed at a position opposing the recording head 21.

The platen 24 includes a plurality of diamond ribs 25 arranged along the direction of movement of the carriage 23 at intervals.

The diamond ribs 25 are configured to support the recording sheet P from the underside when performing the recording on the recording sheet P by the recording head 21, and top surfaces thereof function as supporting surfaces. The distance between the diamond ribs 25 and the recording head 21 can be adjusted according to the thickness of the recording sheet P.

Accordingly, the recording sheet P is capable of passing smoothly on the top surfaces of the diamond ribs 25. On the downstream side of the diamond ribs and the recording head 21, a paper discharge roller mechanism 29 is provided.

The paper discharge roller mechanism 29 includes a paper discharge roller 27 arranged on the downside thereof and a paper discharge serrated roller 28 arranged on the upperside thereof, and is configured to pull and discharge the recording sheet P by the rotation of the paper discharge roller 27.

Here, the relationship of the driving speed of the drive unit 30 of the transporting roller mechanism 19 and the paper discharge roller mechanism 29, the transporting roller 15, and the paper discharge roller 27 will be described.

The printer body 3 is provided with a transporting motor 32 configured to be driven under the control of the controller CONT as shown in FIG. 2A and FIG. 2B. A pinion 33 is provided on a drive shaft of the transporting motor 32, and a transporting drive gear 35 meshes with the pinion 33. The transporting roller 15 is inserted into and coupled to the transporting drive gear 35.

Under such a configuration, the transporting motor 32 or the like constitute the drive unit 30 which drives the transporting roller 15 to rotate.

The transporting roller 15 is provided with the inner gear 39 coaxially with the transporting drive gear 35 on the side of one 16B of the end portions 16A and 16B in the axial direction thereof. An intermediate gear 41 meshes with the inner gear 39 and a paper discharge drive gear 43 meshes the intermediate gear 41. A revolving shaft of the paper discharge drive gear 43 is a shaft member 45 of the paper discharge roller 27 as shown in FIG. 2A. The transporting drive gear 35 and the inner gear 39 are formed integrally, and constitute a gear unit member (a gear member) 40. The gear unit member 40 is formed by molding a resin material such as polypropylene.

Under such a configuration, the transporting roller of the transporting roller mechanism 19 and the paper discharge roller 27 of the paper discharge roller mechanism 29 are configured to be driven by receiving a rotary drive force from the transporting motor 32, which is the common drive source.

The rotational speed of the paper discharge roller is set to be faster than the rotational speed of the transporting roller 15 by adjusting the gear ratio of the respective gears. Therefore, the paper discharging speed of the paper discharge roller mechanism 29 is faster than the transporting speed of the transporting roller mechanism 19 by a speed-up ratio.

Also, a nipping force (a pressing force) applied by the transporting roller mechanism 19 for nipping the recording sheet P is set to be stronger than a nipping force (a pressing force) of the paper discharge roller mechanism 29. Therefore, when the transporting roller mechanism 19 and the paper discharge roller mechanism 29 nip the recording sheet P, the transporting speed of the recording paper is defined by the transporting speed of the transporting roller mechanism 19 irrespective of the paper discharging speed of the paper discharge roller mechanism 29.

Subsequently, the transporting roller 15 and the transporting roller mechanism 19 having the same will be described.

Figure 3A:
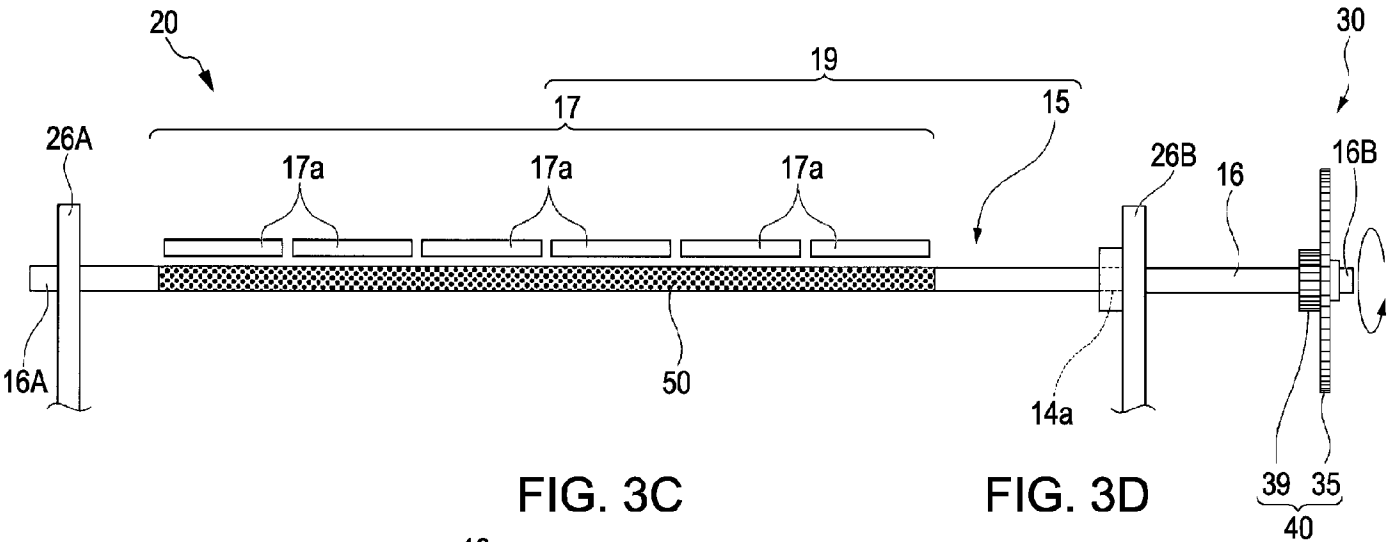
FIG. 3A is a drawing showing a schematic configuration of a transporting roller mechanism.
Figure 3D:
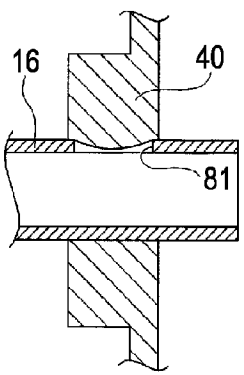
FIG. 3D is an enlarged cross-sectional view showing the principal portion of the roller body.
Figure 3C:
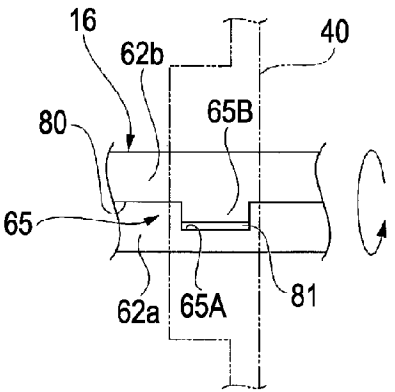
FIG. 3C is a partially enlarged drawing showing a principal portion of a roller body.
Figure 3B:
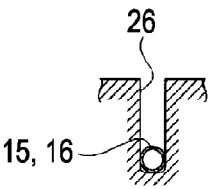
FIG. 3B is a drawing showing a schematic configuration of a bearing.
Figure 4:
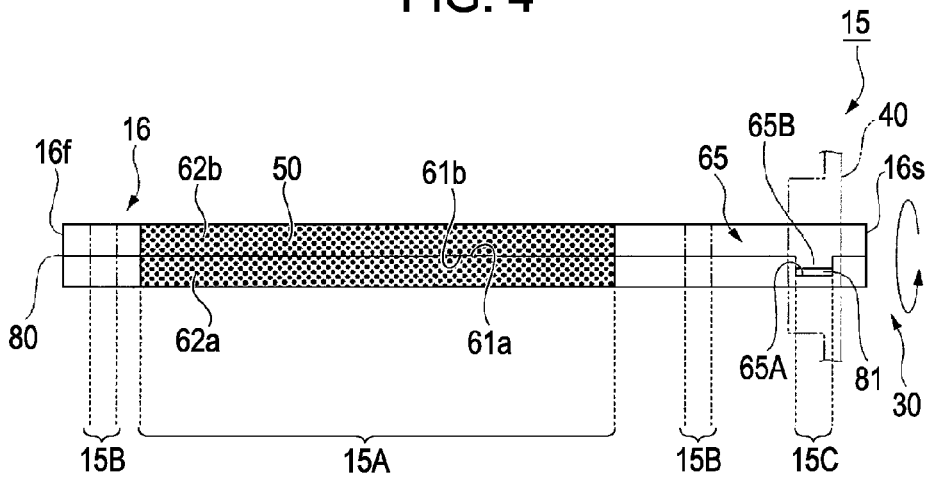
FIG. 4 is a side view showing a configuration of the transporting roller.

FIG. 3A is a drawing showing a schematic configuration of the transporting roller mechanism. FIG. 3B is a drawing showing a schematic configuration of a bearing. FIG. 3C is a partially enlarged drawing showing a principal portion of a roller body 16. FIG. 3D is an enlarged cross-sectional view showing the principal portion of the roller body 16. FIG. 4 is a side view showing a configuration of the transporting roller 15.

The transporting roller 15 includes the hollow cylindrical roller body (a cylindrical shaft) 16 and a high friction layer (a medium supporting area) 50 formed on part of the surface of the roller body 16 in the longitudinal direction (the axial direction). On the outer peripheral surface (a surface) of the transporting roller 15 includes a recording area 15A which comes into contact with the recording sheet P, a pair of supporting areas 15B provided on both sides of the recording area 15A along the axial direction, and a mounting area 15C to which the gear unit member 40 is attached. The recording area 15A is formed with the high friction layer 50.

The roller body 16 is formed of a steel plate coil formed by winding a metal plate such as galvanized steel plate or stainless steel plate as a base material. The roller body 16 is a cylindrical shaft formed by bending a metal plate in a state in which the coil is unwound so that a pair of end surfaces thereof face each other, and is formed into such a cylindrical shape that the surface which used to be an inner peripheral surface side of the coil corresponds to an inner peripheral surface. In other words, the metal plate which forms the roller body 16 is formed into a cylindrical shape in a state in which a roll mark of the coil remains on the inner peripheral surface of the cylinder in a warped shape.

The roller body 16 has a joint line 80 formed between a pair of end surfaces 61*a* and 61*b* of the metal plate bent and brought into abutment with each other. The peripheral direction (the bending direction) and the coil winding direction (the rolling direction of the metal plate) of the roller body 16 are the same, and the joint line 80 is formed to be substantially parallel to the axial direction of the roller body 16.

As shown in FIG. 3A and FIG. 4, the transporting roller 15 is rotatably held by bearings 26A and 26B both ends (a first end portion 16*f* and a second end portion 16*s*) of which are integrally formed with the platen 24 (see FIG. 1). As shown in FIG. 3B, the bearings 26A and 26B are each formed into a U-shape opening upward, and bear the transporting roller 15 from three directions of front, rear, and lower side by allowing the transporting roller 15 to be fitted into the U-shaped portion. Then, lubricant (lubricating agent) G such as grease is supplied (applied) on a contact surface between the bearings 26A and 26B and the transporting roller 15 (the outer peripheral surface of the transporting roller 15).

Here, the configuration of the transporting roller 15 in this embodiment will be described in detail.

As shown in FIGS. 3A and 3C, the roller body 16 (the transporting roller 15) which constitutes the transporting roller 15 is formed with a joint portion 65 which causes parts of the pair of the end surfaces 61*a* and 61*b* to engage with each other in the circumferential direction on the pair of the end surfaces 61*a* and 61*b* which form the joint line 80. The joint portion 65 is formed at the second end portion 16*s* on the side of the drive unit 30 in the direction of the axis of the roller body 16 (see FIG. 4).

More specifically, the joint portion 65 is provided in the mounting area 15C. The joint portion 65 according to this embodiment engages the gear unit member 40 (the transporting drive gear 35 and the inner gear 39), and has a function as a fixing member which prevents these gears from rotating. Also, since the joint portion 65 is provided at a position close to the drive unit 30, the resistance with respect to a rotational torque is increased, so that torsion of the transporting roller 15 can be prevented.

Although the case where only one joint portion 65 is formed has been described as an example in this embodiment, the invention is not limited thereto. A plurality of joint portions 65 may be formed as long as they are formed at positions other than an area where the high friction layer 50 is formed (the recording area 15A) and areas (the supporting areas 15B and 15B) supported by the bearings 26A and 26B.

This is because there may arise problems such that distortion of images or lowering of the accuracy of transport may occur if the joint portion 65 is provided in the recording area 15A, and abrasion of the bearings 26A and 26B becomes severe if the joint portion 65 is provided at portions where the bearings 26A and 26B (FIG. 3A) are arranged.

The joint portion 65 includes a depression 65A formed on the one end surface 61*a* of the pair of the end surfaces 61*a* and 61*b* of the metal plate which form the joint line 80, and a projection 65B formed on the other end surface 61*b* and engaged with the depression 65A and is formed into a hook shape. The projection 65B projects in the direction of normal rotation of the transporting roller 15, and engages the depression 65A in a state of being press-fitted.

In this embodiment, a gap is formed between the depression 65A and the projection 65B, and the gap forms an opening 81. This gap has a dimension in the direction of radius of the roller body 16 on the order of 1 to 5 mm, and a dimension in the direction of the length of the roller body 16 on the order of 5 to 6 mm.

The gear unit member 40 engages the opening 81 (see FIG. 3D). The gear unit member 40 is attached to the joint portion 65 in the mounting area 15C by press-fitting as described later. In other words, the inner diameter of the gear unit member 40 is smaller than the outer diameter of the roller body 16. The dimension of the gear unit member 40 is set to a length on the order of 13 to 17 mm in the direction of the length of the roller body 16.

The gear unit member 40 is formed of a resin material as described above and is deformed and enters the opening 81 after the press-fitting, and hence a state of being caught in the direction of rotation of the roller body is assumed. Therefore, the gear unit member 40 is mounted in the mounting area 15C of the transporting roller 15 in a state of being prevented from rotating. Also, the gear unit member 40 engages the opening 81 of the joint portion 65, so that the position in the direction of the length of the roller body 16 is fixed. In other words, the gear unit member 40 is fixed reliably at a predetermined position in the direction of the length of the roller body 16 by being press-fitted into the roller body 16 and being caught by and engaged with the opening 81.

The gear unit member 40 attached to the transporting roller 15 as described above is required to have a predetermined resistance against a torque (for example, on the order of 2 Kgfcm) in order to transmit the drive force of the drive unit 30 efficiently. In contrast, in the case of the transporting roller of the related art having the roller body formed of a solid shaft, it is necessary to press-fit the gear unit member into the roller body with a pressure on the order of 60 to 80 Kgf in order to realize the resistance against the torque as described above.

The roller body 16 according to this embodiment is formed of a metal plate bent and brought into abutment as described above, and is lower in rigidity in comparison with the roller body formed of the solid shaft. Therefore, when the gear unit member 40 is press-fitted at the pressure as described above (on the order of 60 to 80 Kgf), the roller body 16 is subject to plastic deformation caused by buckling. The transporting roller 15 formed of the roller body 16 subject to the plastic deformation causes axial deflection at the time of rotation, so that the transporting accuracy of the recording sheet P may be lowered.

In contrast, since the transporting roller 15 according to this embodiment uses the joint portion 65 as an engaging device of the gear unit member 40, the gear unit member 40 is mounted in a state of having the predetermined resistance against the torque. Accordingly, since the transporting roller 15 has the predetermined resistance against the torque by the gear unit member 40 engaged with the joint portion 65, it is not necessary to increase the resistance against the torque by increasing a press-fitting force as in the case of the solid roller body of the related art. In other words, the press-fitting force can be decreased.

Therefore, the inner diameter of the gear unit member 40 can be increased to be relatively larger than the outer diameter of the roller body 16, so that the press-fitting of the gear unit member 40 into the roller body 16 is achieved only with a pressure on the order of half the pressure (on the order of 30 to 40 Kgf) of the related art. Therefore, the plastic deformation of the roller body 16 due to the buckling as described above is prevented. In addition, since the gear unit member 40 is fixed in a state of being caught by the opening 81, even when the press-fitted portion is changed with time, the press-fitted portion is preferably held by the roller body 16.

Also, since the gear unit member 40 is mounted on the roller body 16 by the press-fitting, it is not necessary to fix the gear unit member 40 to the roller body 16 by using other members such as a pin or a screw. Therefore, the number of components of the transporting roller 15 is reduced, and hence cost reduction and improvement of assembleability are achieved.

As shown in FIG. 3A and FIG. 4, the high friction layer 50 is formed selectively at a center portion except for both end portions of the roller body 16 in the axial direction. On the surface of the high friction layer 50, inorganic particles are fixed in a state of exposing sharply pointed portions thereof to demonstrate a high frictional force.

The high friction layer 50 is formed by forming a resin film by selectively applying resin particles in a predetermined area on the surface of the roller body 16 at a uniform thickness on the order of 10 μm to 30 μm, and spraying the inorganic particles on the resin film, and then sintering the same. As the resin particles, fine particles having a diameter on the order of 10 to 20 μm formed of an epoxy-based resin or a polyester-based resin or the like are preferably used. As the inorganic particles, ceramic particles such as aluminum oxide (alumina; $Al_2O_3$) or silicon carbide (SiC), and silicon dioxide ($SiO_2$) adjusted to a predetermined particle size distribution by crushing are preferably used.

The driven roller 17 includes a plurality of (six, for example) rollers 17*a* arranged coaxially, and arranged at a position opposing and coming into abutment with the high friction layer 50 of the transporting roller 15. The driven roller 17 including these rollers 17*a* are attached with urging springs (not illustrated), whereby the driven roller 17 is urged toward the transporting roller 15.

Therefore, the driven roller 17 is configured to come into contact with the high friction layer 50 of the transporting roller 15 at a predetermined pressing force (the nipping force with respect to the recording sheet P) and be driven to rotate by the rotational movement of the transporting roller 15. Also, the force of nipping the recording sheet P between the transporting roller 15 and the driven roller 17 is increased, and transportability of the recording sheet P is improved.

Surfaces of the respective rollers 17*a* of the driven roller 17 are formed with a low-abrasion process such as fluoropolymer plating for alleviating damage caused by sliding contact with the high friction layer 50.

A transporting unit 20 of the ink jet printer 1 includes the transporting roller 15, the bearings 26A and 26B, the drive unit 30, and the driven roller 17 described above. The transporting unit 20 supports the transporting roller 15 which provides a high transporting accuracy as described above by a pair of the bearings 26A and 26B and rotates the same, and the high friction layer 50 can support the recording sheet P and transports the same with high degree of accuracy.

Since the gear unit member 40 of the transporting unit 20 is engaged with the joint portion 65 (the opening 81), the gear unit member 40 is fixed to the roller body 16. Therefore, the drive force of the drive unit 30 is reliably transmitted to the gear unit member 40, whereby the transporting operation of the recording sheet P can be performed with high degree of accuracy. Although the transporting roller 15 is assembled by press-fitting the gear unit member 40 into the hollow roller body 16 as described above, the plastic deformation of the roller body 16 is prevented.

Referring now to FIG. 1 and FIGS. 2A and 2B, the action of the ink jet printer 1 will be described.

The ink jet printer 1 feeds the recording sheet P located at a topmost position in the paper feed tray 11 toward the downstream side by pinching the topmost recording paper with the paper feed roller 13. The fed recording sheet P reaches the transporting roller mechanism 19. The transporting roller mechanism 19 pinches the recording sheet P between the transporting roller 15 and the driven roller 17, and transports the recording sheet P toward a position below the recording head 21 at a constant speed by the paper feeding operation by the rotation of the transporting roller 15. The recording sheet P transported to the position below the recording head 21 is subject to high-quality recording by the recording head 21 while passing on the top surfaces of the diamond ribs 25 smoothly. The recording sheets P recorded by the recording head 21 are discharged in sequence by the paper discharge roller 27 of the paper discharge unit 7.

Since the transporting speed of the paper discharge roller mechanism 29 is set to be faster than the transporting speed of the transporting roller mechanism 19, the recording sheet P is transported in a state of being applied with a back tension. However, when the transporting roller mechanism 19 and the paper discharge roller mechanism 29 nip the recording sheet P, the transporting speed of the recording paper is defined by the transporting speed of the transporting roller mechanism 19. Therefore, when performing the paper discharge and the paper transport simultaneously with the paper discharge roller mechanism 29 and the transporting roller mechanism 19 in this manner, the speed of transporting the recording sheet P is defined by the transporting speed of the transporting roller mechanism 19. Therefore, the accurate and stable paper feed (transport) is achieved without irregular transport.

Here, when supporting and transporting the recording sheet P by the high friction layer 50 of the transporting roller 15, a torque is applied to the roller body 16. Then, a stress is applied to a direction in which the joint line 80 (see FIG. 4) of the pair of the end surfaces 61*a* and 61*b* of the metal plate which form the roller body 16 opens. When the joint line 80 of the roller body 16 opens, the transporting roller 15 does not come into contact with the recording sheet P uniformly, so that the irregular transport may occur.

However, in this embodiment, part of the joint line 80 of the roller body 16 of the transporting roller 15 is formed into a hook shape and, as described above, the joint portion 65 is formed at the end surfaces 61*a* and 61*b* of the metal plate which form the joint line 80 of the roller body 16. Accordingly, even when the rotational torque acts on the roller body 16, application of the stress in the direction in which the joint line 80 of the end surfaces 61*a* and 61*b* opens can be prevented.

In the joint portion 65, the projection 65B formed so as to project in the direction of normal rotation (the direction of feeding the recording sheet P) on the one end surface 61*b* which forms the joint line 80 is fitted into the depression 65A formed at a position opposing thereto in the circumferential direction of the other end surface 61*a* in a press-fitted state.

Therefore, the joint portion 65 can resist the maximum torque from the drive unit 30, so that twisting of the transporting roller 15 is prevented and generation of deformation such thou the joint line 80 opens can be prevented effectively.

In this embodiment, the roller body 16 of the transporting roller 15 is formed of the metal plate in a state in which the roll mark of a steel plate coil remains, and is formed into a cylindrical shape such that the surface which used to be the inner peripheral side of the coil corresponds to the inner peripheral surface. The roll mark of the metal plate originated by the steel plate coil is such that the surface which used to be the inner peripheral surface of the steel plate coil becomes a concave surface. In other words, the metal plate which forms the roller body still has a roll mark which warps toward the inner peripheral surface of the roller body 16.

Therefore, the roll mark does not act at least in the direction of opening the joint line 80 of the roller body 16. Therefore, in comparison with a case where the roll mark which warps toward an outer peripheral surface of the roller body 16, the joint line 80 of the roller body 16 can be prevented from opening easily. In other words, according to this embodiment, even when the stress acts in the direction of opening the joint line 80 of the roller body 16, the joint line 80 can be prevented from opening, and hence the transporting roller 15 which achieves a high degree of transporting accuracy can be provided.

Also, the circumferential direction (the bending direction) of the roller body 16 and the direction of winding of the steel plate coil (the rolling direction of the metal plate) are the same. Therefore, the bending direction and the direction of the warp caused by the roll mark of the metal plate which forms the roller body 16 can be matched. Accordingly, the roll mark of the metal plate which forms the roller body 16 acts in the direction of closing the joint line 80 of the roller body 16. Therefore, the opening of the joint line 80 of the roller body 16 can be prevented more effectively.

Also, by employing the hollow cylindrical shaft as the roller body 16, the weight can be reduced significantly in comparison with the case where the solid shaft is used. Also, in comparison with the case where the solid shaft is used as the roller body 16, the requirement for machinability of the material is lowered. Therefore, materials which do not contain harmful matter such as lead can be used as the material of the roller body 16, so that the environmental load can be reduced.

Also, the transporting roller 15 is formed with the high friction layer 50, and the driven roller 17 is arranged at a position coming into abutment with the high friction layer 50. Therefore, the force of nipping the recording sheet P between the transporting roller 15 and the driven roller 17 is increased, and the transportability of the recording sheet P is improved. Also, since the transporting roller 15 is fixed to the roller body 16 by the engagement of the gear unit member 40 with the joint portion 65, the gear unit member 40 can reliably transmit the drive force of the drive unit 30. Also, the hollow roller body 16 is prevented from the plastic deformation by a press-fitting step, occurrence of the axial deflection at the time of transport of the recording sheet P is prevented. In this manner, the ink jet printer 1 according to this embodiment is capable of transporting the recording sheet P by the transporting unit 20 with high degree of accuracy over a long term, and the recording process with respect to the recording sheet P with high reliability can be performed with high degree of recording accuracy.

Subsequently, a manufacturing apparatus configured to manufacture the transporting roller 15 will be described.

Figure 5:
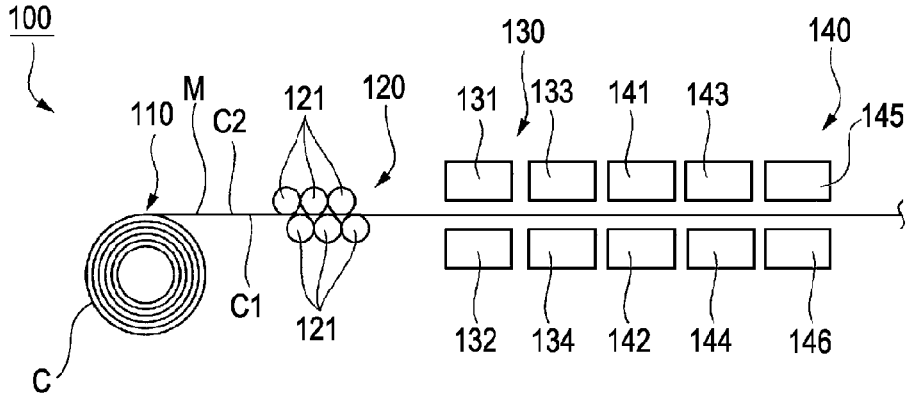
FIG. 5 is a schematic drawing showing a transporting roller manufacturing apparatus according to the embodiment.

FIG. 5 is a schematic drawing showing the manufacturing apparatus configured to manufacture the transporting roller 15 according to this embodiment.

As shown in FIG. 5, a manufacturing apparatus 100 includes an uncoiler 110, a leveler 120, a first pressing machine 130, and a second pressing machine 140 arranged in one direction. Also, the manufacturing apparatus 100 includes the transporting unit, not illustrated, configured to feed a metal plate M unwound from a coil C, and a cutting unit, not illustrated, configured to cut off a processed cylindrical shaft from the metal plate M.

The uncoiler 110 is configured to support the cylindrical coil (the steel plate coil) C formed by winding the metal plate M in the rolling direction so as to be rotatable about the axis and unwind the coil C.

The leveler 120 is provided with a plurality of work rolls 121 arranged alternately on the upper side and the lower side, and is configured to flatten the metal plate M by passing the metal plate M between the upper and lower work rolls 121. The leveler 120 in this embodiment is configured to adjust the roll mark to an extent which allows processing by the first pressing machine 130 without eliminating the roll mark (warp) originated by the coil C of the metal plate M completely.

The first pressing machine 130 includes a male die (a punch) 131 and a female die (a die) 132, and is configured to punch the metal plate M into a predetermined shape by pressing.

The second pressing machine 140 includes a plurality of female dies (bending dies) 141 and 143 and female dies (bending punches) 142 and 144, and an upper die 145 and a lower die 146, and the metal plate M is bent by pressing. Then, by bending the metal plate M with different dies in sequence while feeding the metal plate M intermittently in one direction by the transporting unit, not illustrated, (forward feeding) the metal plate M is deformed gradually toward a cylindrical shape.

Subsequently, a method of manufacturing the transporting roller 15 will be described.

First of all, a cold rolled steel plate having a thickness on the order of 0.8 mm to 1.2 mm and the coil C formed by winding the metal plate M such as an electrolytic zinc-coated steel plates in the rolling direction are prepared. Then, the coil C is supported by the uncoiler 110 of the manufacturing apparatus 100, and the coil C is axially rotated to unwind the metal plate M. The metal plate M unwound from the coil C is in a state of having an arcuate roll mark in side view having a concave surface corresponding to a surface C1 on the inner peripheral side of the coil C and a convex surface corresponding to a surface C2 on the outer peripheral surface side remained. The unwound metal plate M is transported in one direction (the rolling direction) by the transporting unit, not illustrated, and reaches the leveler 120.

The metal plate M having reached the leveler 120 is flattened by the plurality of the work rolls 121 arranged on the upper side and lower side, and its roll mark is adjusted. Accordingly, the metal plate M is flattened to an extent which can be processed by the first pressing machine 130, but such a roll mark that the surface C1 on the inner peripheral side of the coil C remains in the concave surface is remained to some extent. The metal plate M flattened by the leveler 120 is transported in one direction by the transporting unit, not illustrated, and reaches the first pressing machine 130.

Figure 6A:
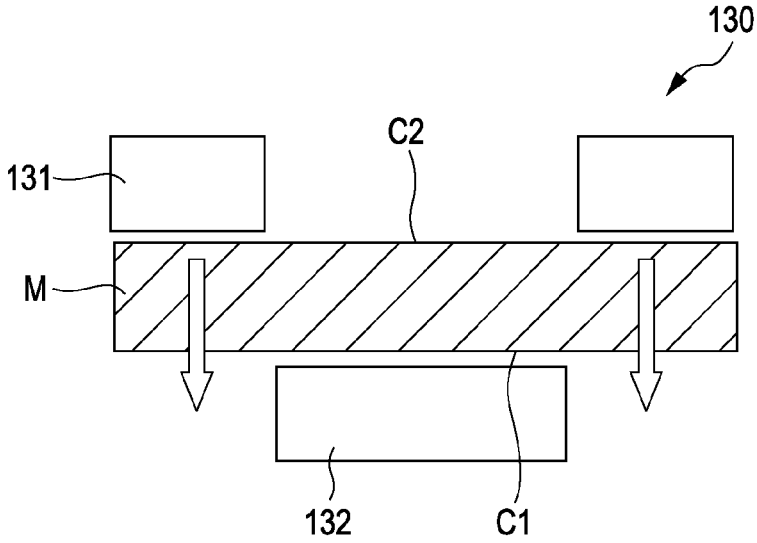
FIGS. 6A and 6B are cross-sectional views showing a punching step according to the embodiment.
Figure 6B:
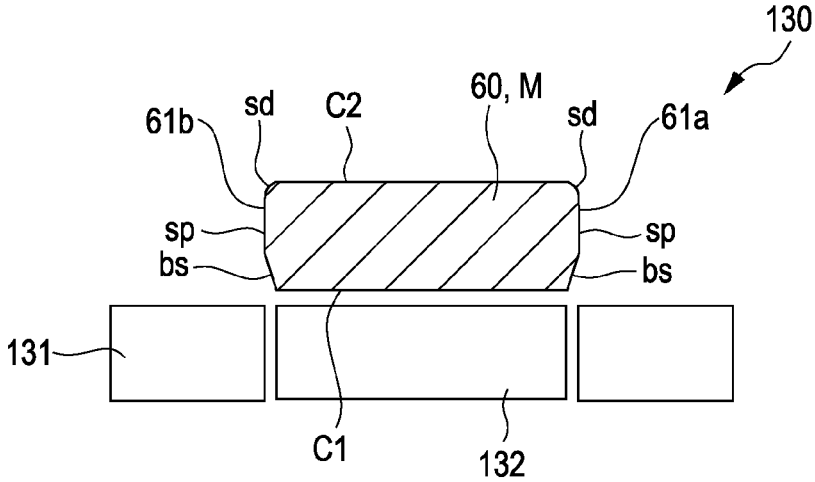

The metal plate M having reached the first pressing machine 130 is subject to a punching process by being pressed using the male die 131 and the female die 132. In this punching process, the metal plate M, which is punched by the punching process as shown in FIGS. 6A and 6B, is used as the base material. In this case, the depression 65A and the projection 65B are formed respectively on long sides 60*b* and 60*b* of a flat plate portion 60.

Figure 7:
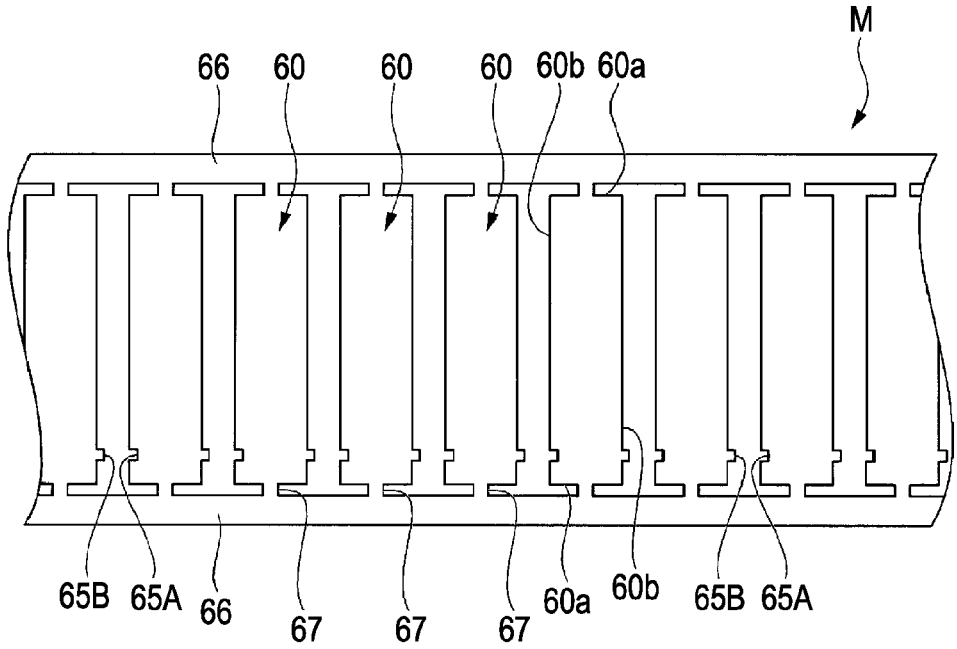
FIG. 7 is a plan view of a metal plate punched by a first pressing machine.

FIG. 7 is a plan view of the metal plate M punched by a first pressing machine.

As shown in FIG. 7, the metal plate M is formed with a frame portion 66 continuing in the direction of transport (the rolling direction), the band-shaped flat plate portions 60 extending in the direction intersecting the direction of transport, and joint portions 67 coupling the frame portion 66 and the flat plate portion 60 by punching. In this embodiment, the flat plate portions 60 are each punched into a substantially rectangular shape, having a short side 60*a* extending in parallel to the rolling direction, and the long side 60*b* extending in the direction orthogonal to the rolling direction. As described above, the long sides 60*b* and 60*b* are formed with the depression 65A and a projection 65B, respectively. By performing pressing repeatedly while transporting the metal plate M intermittently by the transporting unit, not illustrated, a plurality of the flat plate portions 60 and the joint portions 67 are formed equidistantly in the direction of transport of the metal plate M.

The metal plate M punched by the first pressing machine 130 is transported by the transporting unit, not illustrated, and reaches the second pressing machine 140 shown in FIG. 5.

Then, the metal plate M as the base material of the roller body 16 is bent into a cylindrical shape having the upper surface C2 shown in FIG. 6B as the outer peripheral surface thereof.

FIGS. 8A to 8C and FIGS. 9A to 9C are side views showing the bending process performed by a second pressing machine. The flat plate portion 60 of the metal plate M having reached the second pressing machine 140 is bent in the direction parallel to the short side 60*a* shown in FIG. 7 (the rolling direction) by pressing. In other words, the metal plate M is bent so as to bring the pair of end surfaces extending along the long sides 60*b* and 60*b* on both sides of the flat plate portion 60 into proximity to each other. Then, as shown in FIGS. 8A to 8C and FIGS. 9A to 9C, the metal plate M is formed into a cylindrical shape by bringing the pair of end surfaces into abutment so as to oppose each other.

Figure 8A:
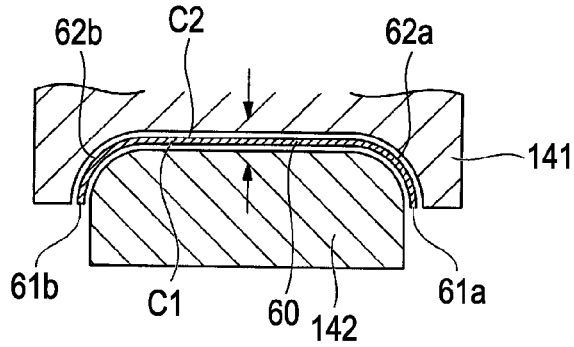
FIGS. 8A to 8C are side views showing a bending step performed by a second pressing machine.

More specifically, the female die (the bending die) 141 and the male die (the bending punch) 142 shown in FIG. 8A are firstly used for pressing the flat plate portion 60 of the metal plate M, and then both end portions 62*a* and 62*b* of the flat plate portion 60 are bent into an arcuate shape (preferably, substantially ¼ arc). In FIG. 8A, the flat plate portion 60, the female die 141, and the male die 142 are illustrated with gaps interposed therebetween in order to facilitate understanding of the respective members. However, these gaps do not exist actually, and the flat plate portion 60 is almost in tight contact with the female die 141 and the male die 142 at respective contact portions. The same applies to FIGS. 8B, 8C, and FIGS. 9A to 9C.

Figure 8B:
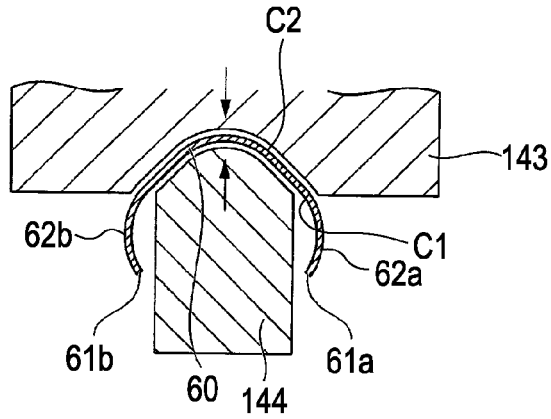
Figure 8C:
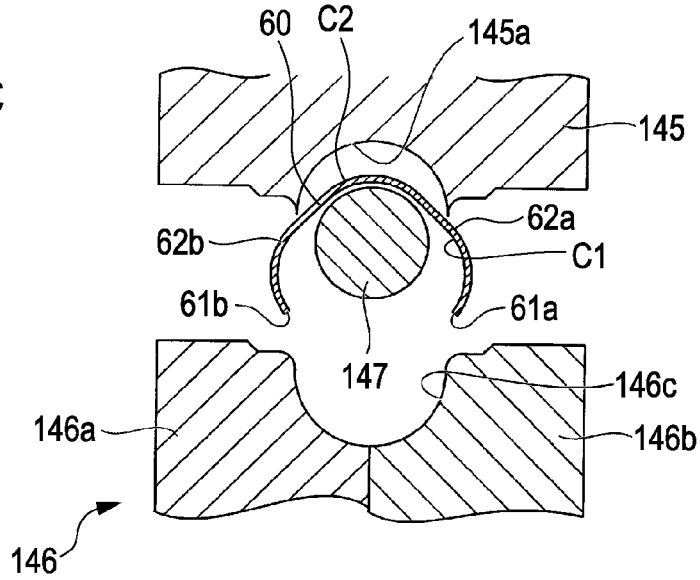

Here, the male die 142 is arranged so as to oppose the surface C1 which used to be the inner peripheral side of the coil C shown in FIG. 5 (the lower surface of the flat plate portion 60 in FIGS. 8A to 8C). The female die 141 is arranged so as to oppose the surface C2 which used to be the outer peripheral side of the coil C shown in FIG. 5 (the upper surface of the flat plate portion 60 in FIGS. 8A to 8C). Accordingly, the both end portions 62*a* and 62*b* of the flat plate portion 60 are bent toward the surface C1 which used to be the inner peripheral surface of the coil C.

Subsequently, after having fed the metal plate M in one direction, a center portion of the flat plate portion 60 in the short side direction (the bending direction) is pressed using the second female die (the bending die) 143 and the second male die (the bending punch) 144 shown in FIG. 8B. Then, the flat plate portion 60 is bent into an arcuate shape (preferably, substantially ¼ arc) toward the surface C1 which used to be the inner peripheral side of the coil C shown in FIGS. 6A and 6B.

Subsequently, after having fed the metal plate M in the one direction, the core die 147 is arranged inside the flat plate portion 60 as shown in FIG. 8C. Then, by using the upper die 145 and the lower die 146 shown in FIG. 8C, the end surfaces 61*a* and 61*b* of the both end portions 62*a* and 62*b* of the flat plate portion 60 are brought into proximity as shown in FIGS. 9A to 9C.

Figure 9A:
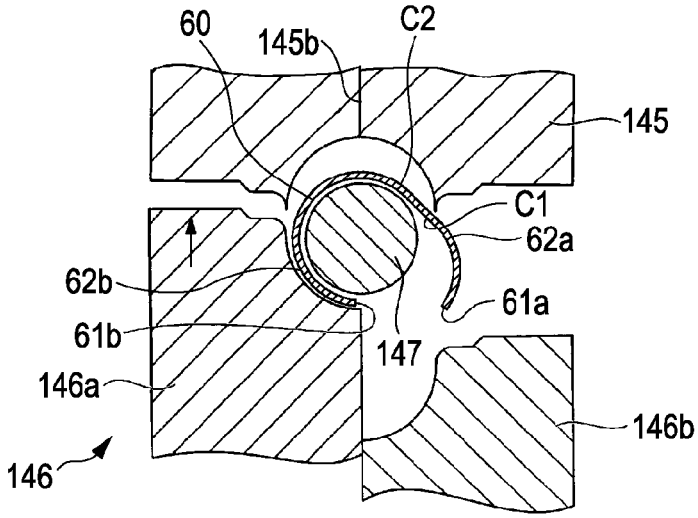
FIGS. 9A to 9C are side views showing the bending step performed by the second pressing machine subsequent to the process shown in FIG. 8C.
Figure 9B:
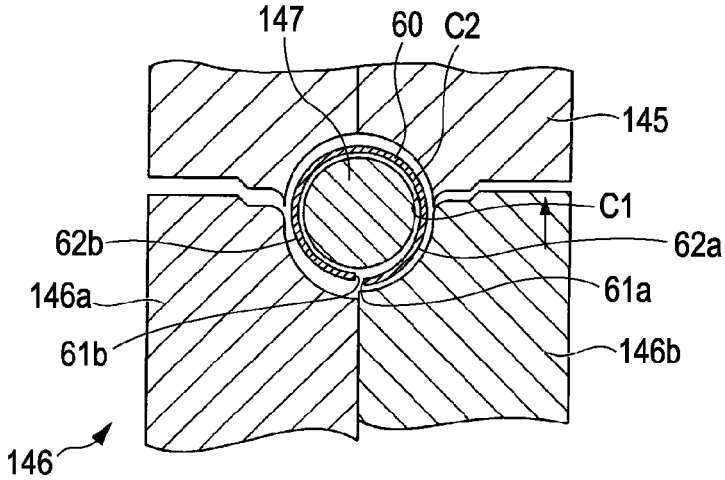
Figure 9C:
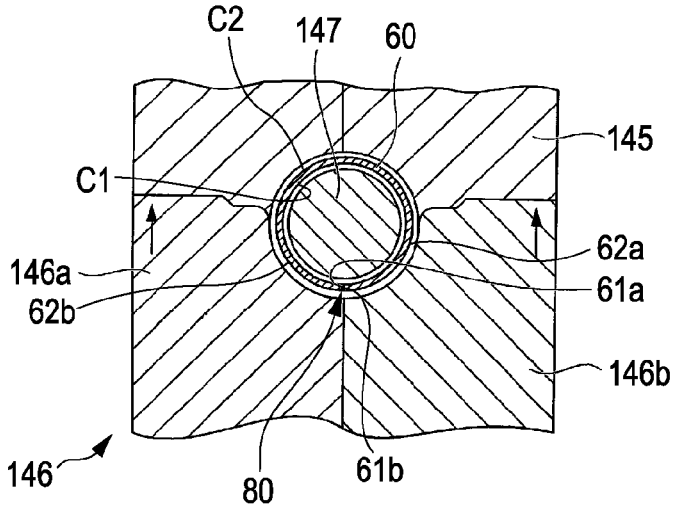

Here, the outer diameter of the core die 147 shown in FIG. 8C and FIGS. 9A to 9C is set to be equal to the inner diameter of the hollow cylindrical-shaped roller body 16 to be formed. As shown in FIG. 8C, the radius of a press surface 146*c* of the lower die 146 and the radius of a press surface 145*a* of the upper die 145 are set to be equal to the radius of the outer diameter of the roller body 16 in which a grinding margin is taken into consideration. Also, as shown in FIGS. 9A to 9C, the lower die 146 includes a pair of left and right split dies, and split dies 146*a* and 146*b* are configured to be movable upward and downward independently.

In other words, from the state shown in FIG. 8C, the split die 146*a* on the left side is brought into proximity to the upper die 145 and one side of the flat plate portion 60 is pressed and bent into a substantially semi-circular shape as shown in FIG. 9A.

The upper die 145 also includes a pair of left and right split dies like the lower die 146 (see a parting surface 145*b*), and the upper die on the same side may be brought into proximity to the split die 146*a* in the step shown in FIG. 9A.

Subsequently, as shown in FIG. 9B, the core die 147 is moved toward the upper die 145 a little (to an extent which can move the end surface 61*a* on one side and the end surface 61*b* on the other side into proximity), the sprit die 146*b* on the other side is brought into proximity to the upper die 145, and the other side of the flat plate portion 60 is pressed into a substantially semi-circular shape.

Subsequently, as shown in FIG. 9C, the core die 147 and a pair of the split dies 146*a* and 146*b* are brought into proximity together to the upper die 145 to form the cylindrical roller body (a hollow pipe) 16. In this state, the end surfaces 61*a* and 61*b* on the both left and right sides are brought into a state of being opposed and in abutment with each other.

In other words, in the cylindrical roller body 16, the end surfaces 61*a* and 61*b* on the both sides of the flat plate portion 60 of the metal plate M as the base material are in the proximity to each other and a joint line is formed between the end surfaces 61*a* and 61*b*. The surface C1 which used to be the inner peripheral side of the coil C shown in FIG. 5 is now the inner peripheral surface of the roller body 16, and the surface C2 which used to be the surface on the outer peripheral side of the coil C is now the outer peripheral surface of the roller body 16. In this manner, the roller body 16 is formed so as to wind the flat plate portion 60 around the core die 147.

Figure 10:
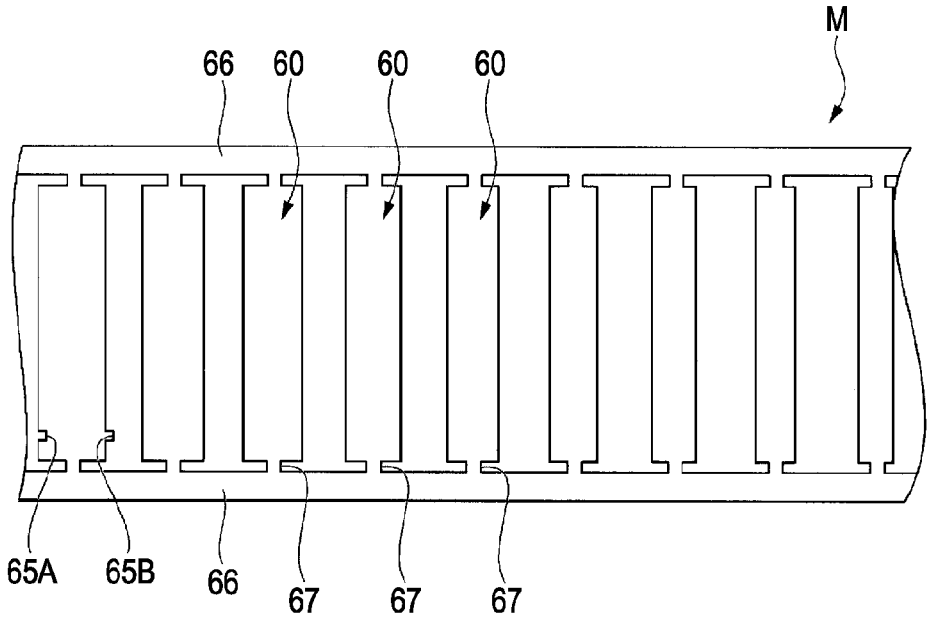
FIG. 10 is a plan view showing a metal plate whose flat plate portion is formed into a cylindrical shape step by step after having subject to the steps shown in FIGS. 8A to 8C and FIGS. 9A to 9C.

FIG. 10 is a plan view showing the metal plate M whose flat plate portion 60 is formed into a cylindrical shape step by step after having subject to the steps shown in FIGS. 8A to 8C and FIGS. 9A to 9C.

The metal plate M punched as shown in FIG. 7 can reach the second pressing machine 140 shown in FIG. 5, and the flat plate portion 60 is bent in sequence by pressing by the steps shown in FIGS. 8A to 8C and FIGS. 9A to 9C (forward feeding press). Therefore, the flat plate portion 60 reaching the second pressing machine 140 becomes closer to the cylindrical shape as shown in FIG. 10 as it goes forward in the direction of transport of the metal plate M. After the flat plate portion 60 has formed into a cylindrical shape, the joint portion 67 is cut by a cutting unit, not illustrated, and the hollow cylindrical roller body 16 is obtained.

In this embodiment, when forming the roller body 16 having the joint line 80 (see FIG. 9C or the like) by brining the pair of the end surfaces 61*a* and 61*b* (FIG. 7) of the metal plate M into abutment, the end surfaces 61*a* and 61*b* are brought into abutment with each other by press-fitting the projection 65B into the depression 65A to form the hook-shaped joint line 80. More specifically, by press-fitting the projection 65B into the depression 65A, the joint portion 65 formed with the opening 81 between the depression 65A and the projection 65B is configured.

Accordingly, occurrence of deformation such thou the joint line 80 opens due to the torque applied at the time of the rotary drive can be prevented. Also, since the projection 65B projects toward the direction of normal rotation of the transporting roller 15, a profound effect of prevention of torsion on the rotational torque of the transporting roller 15 having a heavy load is achieved.

In the punching step, even when a shear drop sd, a shear plane sp, a broken-out section bs, or a squeezed-out projection are formed on the punched metal plate M as shown in FIG. 6B, it is preferable to use the upper surface C2 formed with the relatively smooth shear drop sd as the outer peripheral side of the roller body 16. In other words, it is preferable to use the lower surface C1 of the metal plate M continuing to the squeezed-out projection or the broken-out section bs as the inner peripheral side of the roller body 16.

Accordingly, when forming the roller body 16 having the joint line 80 (see FIG. 9C or the like) by brining the pair of the end surfaces 61*a* and 61*b* of the metal plate M into abutment, the irregular surfaces of the squeezed-out projection or the broken-out section bs serve as obstacles and hence the joint line 80 is prevented from opening.

Subsequently, in this embodiment, a step of adjusting the stress remaining in the formed roller body 16 (a stress adjusting step) is performed. In this stress adjusting step, a pressing force is applied to at least a predetermined portion of the outer peripheral surface 16*a* of the roller body 16, where the high friction layer 50 is formed. In this embodiment, a case where the pressing force is applied to a substantially entire surface of the outer peripheral surface 16*a* of the roller body 16 will be described as an example. In the stress adjusting step, the pressing force can be applied to the roller body 16 using at least one of three steps shown below.

(1) Roll Leveling Step

Figure 11A:
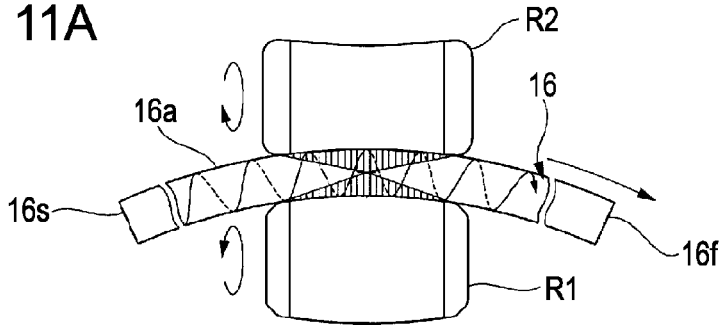
FIGS. 11A to 11D are drawings showing a state of a roll leveling step according to the embodiment.

In the roll leveling step, a plurality of press rollers are used. Here, as shown in FIG. 11A, a case where two press rollers R1 and R2 are used will be described as an example. An outer peripheral surface of the press roller R1 is formed into a convex shape. An outer peripheral surface of the press roller R2 is formed into a concave shape.

First of all, the roller body 16 is clamped by the press rollers R1 and R2. After the roller body 16 has been clamped, the press rollers R1 and R2 are rotated while pressing the roller body 16 by the two press rollers R1 and R2. In this state, the roller body 16 and the press rollers R1 and R2 are moved relatively toward a center axis of the roller body 16.

The positions of the press rollers R1 and R2 are fixed, and the roller body 16 is passed between the press roller R1 and the press roller R2. Accordingly, the pressing force is applied to the roller body 16 in sequence from the first end portion 16*f* to the second end portion 16*s*. With this pressing force, the stress remaining on the roller body 16 is adjusted.

(2) Rolling Step

Subsequently, a case of performing a rolling step will be described.

The rolling step is a process so-called a through feed rolling using two rolling rollers 201 and 202.

Figure 11B:
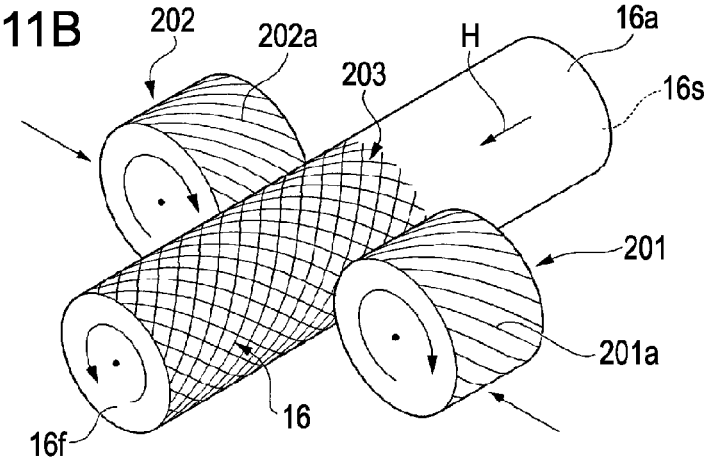

More specifically, as shown in FIG. 11B, the two rolling rollers 201 and 202 arranged so as to clamp the roller body 16 therebetween are brought into a state of being pressed against the roller body 16 at a predetermined pressure. In this state, the two rolling rollers 201 and 202 are rotated in the same direction. In the thorough-feed rolling, the roller body 16 is moved in an axial direction H while rotating in the direction opposite from the direction of rotation of the rolling rollers 201 and 202 by the rotation of the rolling rollers 201 and 202.

Formed on the surfaces of the rolling rollers 201 and 202 are helical-shaped depressions 201*a* and 202*a* in order to form the high friction layer 50, and the depressions 201*a* and 202*a* deform the surface of the roller body 16, so that the surface of the roller body 16 is formed with a grid-type patterned indented portion 203.

In this manner, the patterned indented portion 203 is formed in sequence from the first end portion 16*f* to the second end portion 16*s* of the roller body 16. By the formation of the patterned indented portion 203, the stress remaining on the roller body 16 is adjusted. The depth of the patterned indented portion 203 (the level difference between the projections and depressions) can be set as needed within a range from 5 μm to 50 μm.

In the rolling step, by equalizing the axial dimension of the rolling rollers 201 and 202 and the axial dimension of the roller body 16, the pressing force is applied to the entire part of the roller body 16. In this case as well, the stress remaining on the roller body 16 is adjusted.

(3) Rotating and Pressing Step

Subsequently, a case where a rotating and pressing step is performed will be described.

The rotating and pressing step is a step of rotating the roller body 16 in a state of pressing a pressing member against the roller body 16, and moving the pressing member and the roller body 16 relatively in the direction of the center axis of the roller body 16.

Figure 11C:
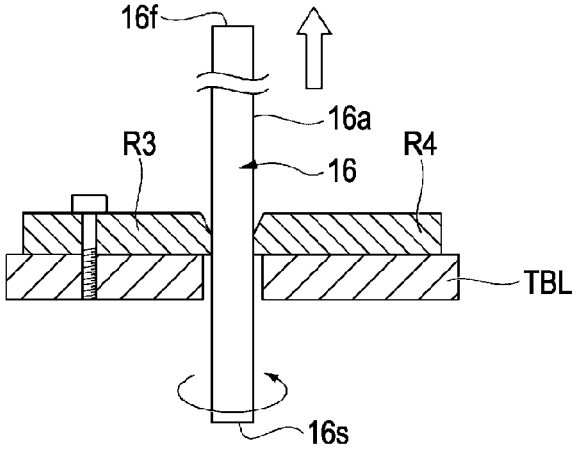

Examples of the rotating and pressing step include moving the roller body 16 as shown in FIG. 11C. In this case, pressing members R3 and R4 are fixed to a table TBL. The distance between the pressing member R3 and the pressing member R4 is set to be rather smaller than the diameter of the roller body 16.

In this state, the roller body 16 is caused to pass between the pressing member R3 and pressing member R4 while being rotated. The pressing member R3 and the pressing member R4 are pressed so as to clamp the roller body 16. Accordingly, the pressing force is applied from the first end portion 16*f* to the second end portion 16*s* of the roller body 16. With this pressing force, the stress remaining on the roller body 16 is adjusted.

Figure 11D:
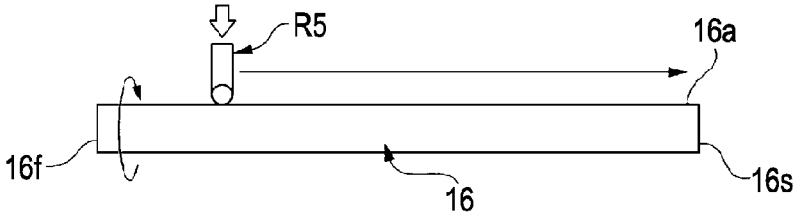

Examples of the rotating and pressing step include moving a pressing member R5 without moving the roller body 16 as shown in FIG. 11D. In this case, the roller body 16 is rotated about the center axis thereof in a state of being fixed in position. In this state, the pressing member R5 is pressed against the roller body 16, and the pressing member R5 is moved along the center axis o the roller body 16.

Accordingly, the pressing force is applied from the first end portion 16*f* to the second end portion 16*s* of the roller body 16. With this pressing force, the stress remaining on the roller body 16 is adjusted. A distal end of the pressing member R5 (a portion coming into abutment with the roller body 16) is preferably formed into a roller shape.

When performing the respective steps in (1) to (3), it is also possible to apply the pressing force to the roller body 16 in a state in which the core member (not illustrated) is inserted into the interior of the roller body 16. Accordingly, the deformation of the roller body 16 by the pressing force can be avoided.

Figure 12A:
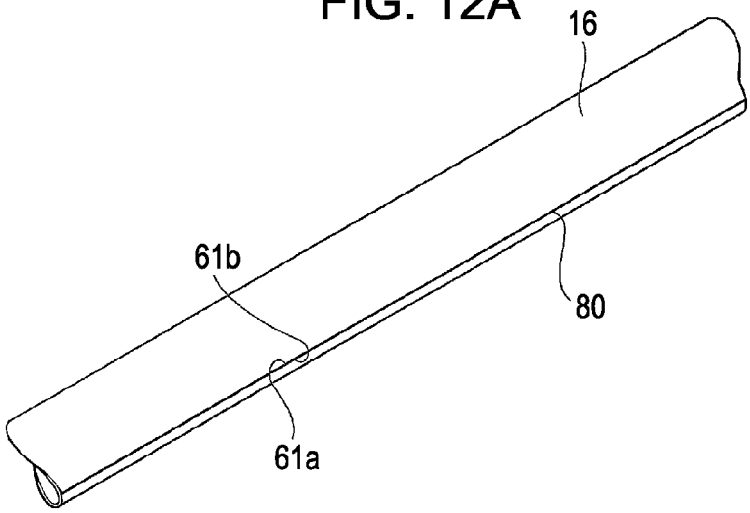
FIG. 12A is a perspective view of the roller body.

Subsequently, in this embodiment, centerless grinding process is performed in order to enhance the circularity of the formed roller body 16 and reduce the deflection. In this grinding step, as shown in FIG. 12C, an outer peripheral surface 16*a* of the roller body 16 is ground using a pair of grinding stone members GD formed into a column shape (or a cylindrical shape). In the grinding step, a portion of the roller body 16 to a predetermined depth (the thickness on the order of 30 μm to 80 μm, hereinafter, referred to as "grinding depth") from the surface is ground.

The roller body 16 is arranged between the pair of the grinding stone members GD arranged at a distance smaller than the outer diameter of the roller body 16, so that a state in which the roller body 16 is in contact with the outer peripheral surfaces of the pair of the grinding stone members GD. Subsequently, the pair of the grinding stone members GD are rotated in the same direction. When the pair of the grinding stone members GD are rotated, a frictional force is generated between each of the grinding stone members GD and the roller body 16.

As the pair of the grinding stone members GD, those formed to have a dimension in a longitudinal direction (the height direction of the column) longer than that of the roller body 16 so as to allow the roller body 16 to be ground entirely in the longitudinal direction at a time. It is also preferable to arrange the roller body 16 at a center in the longitudinal direction of the grinding stone members GD so that the entire part of the roller body 16 in the longitudinal direction comes into contact with the pair of the grinding stone members GD in order to secure a margin in the longitudinal direction thereof when the grinding stone members GD are rotating.

The outer peripheral surface 16*a* of the roller body is ground by the frictional force generated by the rotation of the grinding stone members GD while the roller body 16 is rotating in a direction opposite from the direction of rotation of the grinding stone members GD. Therefore, substantially entire surface of the outer peripheral surface 16*a* of the roller body 16 is evenly ground, and the circularity of the roller body 16 is improved in comparison with that before the grinding step.

When the rolling step is performed in the stress adjusting step, the patterned indented portion 203 formed on the outer peripheral surface 16*a* of the roller body 16 is removed by grinding. Accordingly, the portion of the roller body 16 where the high friction layer 50 is formed is formed with the patterned indented portion 203 having a depth larger than the grinding depth in the grinding step in advance in the rolling step. Also, the portion where the high friction layer 50 is not formed is formed with the patterned indented portion 203 having a depth smaller than the grinding depth in advance.

After the grinding step has performed in this state, part of the patterned indented portion 203 remains in the portion of the roller body 16 where the high friction layer 50 is formed. Also, the patterned indented portion 203 is removed in the portion of the roller body 16 where the high friction layer 50 is not formed. Therefore, the patterned indented portion 203 can be used in the step of forming the high friction layer 50, and hence the production efficiency is enhanced.

After the grinding step has been performed, the roller body 16 with high degree of circularity and small degree of deflection is obtained. In the roller body 16, the gap between the both end surfaces 61*a* and 61*b* is narrowed, and hence the joint line 80 having the further narrowed gap between the both end surfaces 61*a* and 61*b* is formed as shown in FIG. 12A.

In the pressing or grinding processes, it is preferable to eliminate the gap between the both end surfaces 61*a* and 61*b* of the flat plate portion 60, that is, to bring the both end surfaces 61*a* and 61*b* into abutment with each other. However, it is difficult to eliminate the gap completely while improving the circularity and the degree of deflection of the obtained roller body 16, and a certain extent of gap is formed under the existing conditions.

Figure 12B:
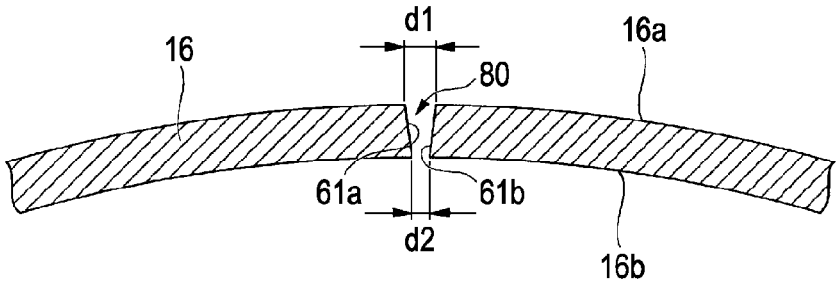
FIG. 12B is a cross-sectional side view showing a joint portion.
Figure 12C:
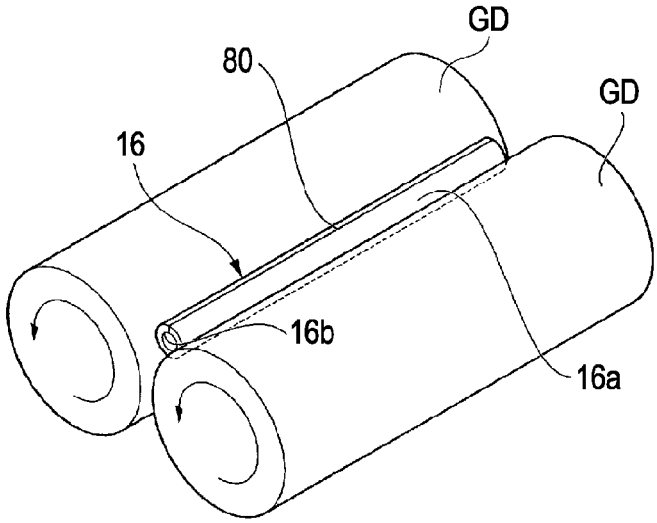
FIG. 12C is a drawing showing a centerless grinding step.

The joint line 80 is such that the distance between the pair of the end surfaces 61*a* and 61*b* is relatively wider on the side of the outer peripheral surface 16*a* of the roller body 16 and relatively narrower on the side of the inner peripheral surface 16*b* as shown in FIG. 12B because the outer peripheral surface and the inner peripheral surface of the flat plate portion 60 have the same dimension (the width).

After the roller body 16 which corresponds to the cylindrical shaft in the invention has formed in this manner, the high friction layer 50 as shown in FIG. 3A and FIG. 4 is formed on the surface of the roller body 16.

As a method of forming the high friction layer 50, a dry method and a wet method (or a combination of these methods) may be employed. However, in this embodiment, the dry method is preferably employed. More specifically, first of all, resin particles and inorganic particles are prepared as the materials used to form the high friction layer 50. As the resin particles, fine particles having a diameter on the order of 10 μm formed of epoxy-based resin, polyester-based resin, or the like are preferably used.

As the inorganic particles, ceramic particles of aluminum oxide (alumina; $Al_2O_3$) or silicon carbide (SiC), silicon dioxide ($SiO_2$), or the like are used more preferably. Among these materials, the alumina is preferably used because the alumina has a relatively higher hardness, demonstrates a function to desirably enhance the abrasion resistance, and is relatively low in price and hence does not hinder cost reduction. Therefore, in this embodiment, the alumina particles are used as the inorganic particles.

As the alumina particles, those adjusted to a predetermined particle diameter distribution by a crushing process are used. By being manufactured by the crushing process, the alumina particles have a relatively pointed ends, and the pointed ends demonstrate a high degree of frictional force.

As the alumina particles in this embodiment, those having a particle diameter in a range from 15 μm to 90 μm and being adjusted to have a particle diameter of a weighted average (an average particle diameter), which is a center diameter, of 45 μm are used.

In other words, in the embodiment of the invention, the alumina particles (the inorganic particles) having an average particle diameter (the center diameter) larger than a distance d1 (30 μm) of the joint line 80 on the side of the outer peripheral surface thereof described above are used.

In particular, as regards a particle diameter distribution (a range of granularity), particles having a diameter smaller than the distance d1 (30 μm) of the joint line 80 on the side of the outer periphery thereof and larger than a distance d2 (10 μm) thereof on the side of the inner peripheral surface are preferably included. In addition, the minimum particle diameter in the particle diameter distribution is preferably larger than the minimum distance between the pair of the end surfaces 61*a* and 61*b*, that is, the distance d2 on the side of the inner peripheral surface thereof of the joint line 80.

When the resin particles and the inorganic particles as described above are ready, the above-described resin particles are applied on the roller body 16 at first. In other words, the roller body 16 is arranged in a coating booth (not illustrated), and also the roller body 16 is set to a – (minus) potential as a single body.

Then, the resin particles are sprayed (ejected) onto the roller body 16 using a Tribo-charging gun of an electrostatic coating apparatus (not illustrated) and, simultaneously, the sprayed particles (the resin particles) are charged into a (plus) high potential. Then, the charged resin particles are adsorbed to the outer peripheral surface of the roller body 16 and form a resin film.

Figure 13A:
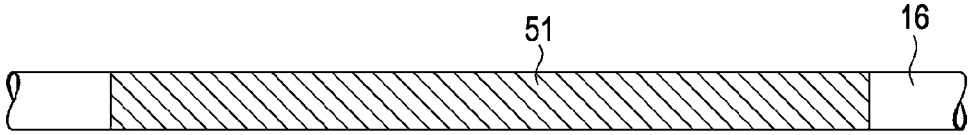
FIGS. 13A to 13C are drawings showing a step of forming a high friction layer on the roller body.
Figure 13B:
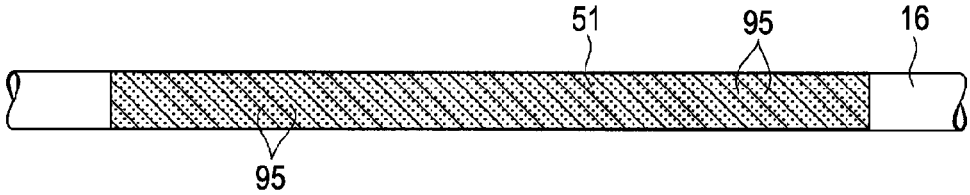
Figure 13C:
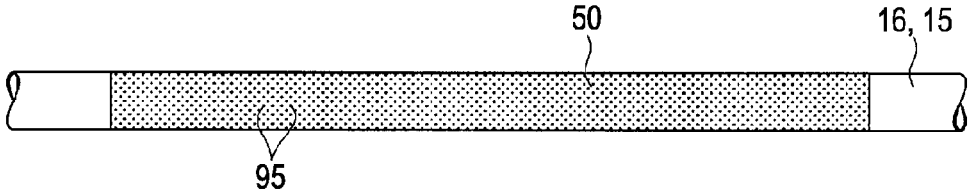

Here, an area of formation of the resin film by the spray of the resin particles is set to match the area of formation of the high friction layer 50 shown in FIG. 3A and FIG. 4. In other words, the formation of the resin film is not performed across the entire length of the roller body 16, but is performed only on the center portion except for both end portions as shown in FIG. 13A by masking the both end portions with a tape or the like. In other words, a resin film 51 is selectively formed only on the area of the transporting roller 15 formed of the roller body 16 corresponding to the center portion, which is an area coming into contact with at least the transported recording sheet (medium) P. In FIG. 13A and FIGS. 13B and 13C described later, illustration of the joint line 80 is omitted.

The resin film 51 has minute static electricity on the order of +0.5 KV remained after the spray coating. When performing the spray coating, the resin film 51 is formed into a substantially even thickness over the entire circumference by rotating the roller body 16 about the axis. The film thickness of the resin film 51 to be formed is on the order of 10 μm to 30 μm by taking the diameter of the alumina particles described above. The film thickness as described above can be adjusted as needed by the amount of ejection and the duration of ejection of the resin particles.

Subsequently, the roller body 16 formed with the resin film 51 is taken out from the above-described coating booth, and is transferred to another coating booth 90 shown in FIG. 14 by a handling robot (not illustrated). In the coating booth 90, a pair of rotary driving members 91 and 91 are provided on the downside thereof, and the rotary driving members 91 and 91 are each provided with a chuck 92 for supporting the roller body 16 in the substantially horizontal direction.

Then, the both end portions of the roller body 16 are fixed by being held by the chucks 92 and 92, and the chucks 92 and 92 are rotated by the rotary driving members 91. Accordingly, the roller body 16 is driven to rotate slowly at a speed on the order of 100 rpm to 500 rpm about the axis. The roller body 16 may be supported slightly obliquely as a matter of course.

Figure 14:
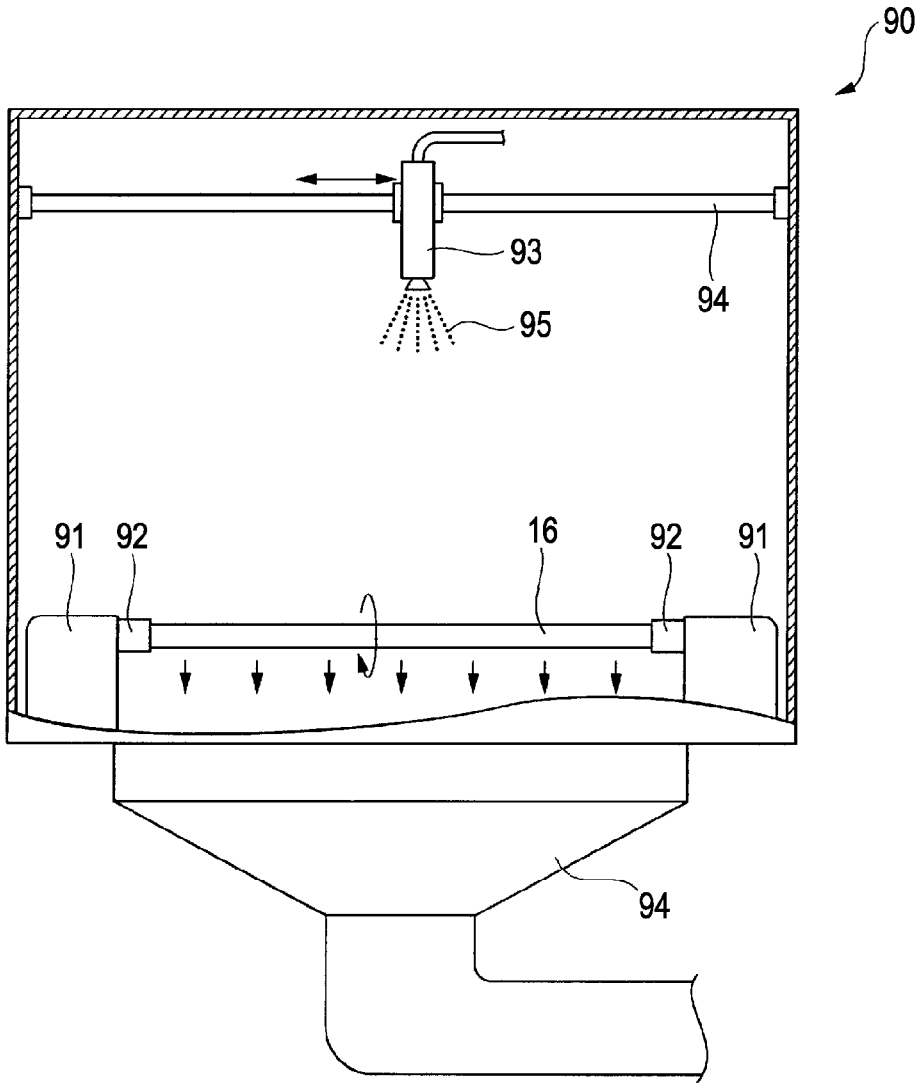
FIG. 14 is a schematic drawing showing a configuration of a coating booth for forming the high friction layer.

A corona gun 93 is arranged in the coating booth 90 in an upper portion, and the corona gun 93 is configured to move in the lateral direction on a shaft 94 in FIG. 14. A discharge mechanism 90*a* is provided on a bottom portion of the coating booth 90. Accordingly, a slow airflow directed downward is generated in the coating booth 90. The amount of intake air of the discharge mechanism 90*a* can be set as needed.

With such a configuration, by spraying the above-described alumina particles 95 from the corona gun 93 while rotating the roller body 16 about the axis, the alumina particles 95 are selectively adsorbed electrostatically onto the resin film 51 formed on the roller body 16. In order to cause the alumina particles to be adsorbed electrostatically selectively onto the resin film 51, the spray is performed in a state in which the both end portions of the roller body 16 are masked with a tape or the like in the same manner as the formation of the resin film 51.

The electrostatic coating is performed so that the surface potentials of the chuck 92 and the rotary driving member 91 become substantially equal to that of the roller body 16, and, in addition, the inner surface potential of the coating booth 90 becomes electrically neutral and is substantially zero potential, in order to prevent the alumina particles 95 from the corona gun 93 from being adsorbed to a portion other than the roller body 16. In order to hold the inner surface potential of the coating booth 90 electrically neutral, the coating booth 90 is preferably manufactured using a steel plate having an inner surface electric resistance on the order of 1011 ohm.

Then, the potential to be applied to the corona gun is set to 0 V, and also the pressure of air to be supplied to the corona gun 93 is set to a pressure on the order of 0.2 Mpa. Subsequently, the corona gun 93 is moved in the lateral direction in FIG. 14, and the alumina particles 95 having a substantially zero potential are sprayed from above, so that the alumina particles 95 are dropped spontaneously under its own weight in the vertical direction.

Then, as described above, since minute static electricity (approximately +0.5 KV) is remained on the resin film 51 of the roller body 16 because the resin film 51 is formed by the electrostatic coating, the alumina particles are electrostatically adsorbed on the entire circumference of the resin film 51 substantially evenly by the remaining static electricity. The alumina particles 95 electrostatically absorbed in this manner is adhered to the outer peripheral surface of the roller body 16 with the resin film 51 as a binder in a state of being in abutment with the surface of the resin film 51 and being party entered therein.

Here, the inner surface potential of the coating booth 90 is electrically neutral and is substantially zero potential and, in addition, the airflow in the coating booth 90 is a downward slow flow in this embodiment, so that the alumina particles 95 drop downward spontaneously in the vertical direction under its own weight. Since the roller body 16 supported horizontally is rotated slowly about the axis thereof on the downside in the direction of dropping of the alumina particles 95, the alumina particles 95 are sprayed substantially evenly on the outer peripheral surface of the roller body 16.

Therefore, the alumina particles 95 are evenly adhered to the surface of the resin film 51 where the masking is not specifically provided, whereby the alumina particles (the inorganic particles) 95 are dispersed on the roller body 16 in the resin film 51 at the center thereof and are exposed therefrom as shown in FIG. 13B. In other words, when the alumina particles 95 come into abutment with the resin film 51 by an electrostatic absorption force, part of the alumina particles 95 enter the resin film 51, and remaining portions project from the surface of the resin film 51. At this time, since the alumina particles 95 apt to stand vertically upright with respect to the surface of the roller body 16, the alumina particles 95 are distributed evenly and most of the alumina particles 95 are adhered with its pointed end portions (tip portions) directed outward.

The alumina particles 95 demonstrate a high frictional force by their end portions projecting from the surface of the resin film 51. Here, in order to cause the alumina particles 95 to demonstrate required and sufficient degree of frictional force with respect to the recording sheet P, the surface area of the alumina particles 95 is preferably 20% to 80% of the surface area of the resin film 51.

The application (spraying) of the alumina particles 95 is not limited to the application using the electrostatic coating method as long as the alumina particles 95 are sprayed slowly downward in the vertical direction, and the application (spraying) method using a spray gun is also applicable.

After the alumina particles 95 have been sprayed and adhered on the resin film 51 in this manner, the roller body 16 is heated for a period on the order of 20 to 30 minutes at a temperature on the order of 180° C. to 300° C., and the resin film 51 is sintered and hardened. Accordingly, the alumina particles 95 can be secured to the roller body 16. In this manner, the high friction layer 50 formed of the alumina particles (the inorganic particles) 95 are dispersed in and exposed from the resin film 51 as shown in FIG. 13C is formed, whereby the transporting roller 15 according to the invention is obtained.

Although the application (spraying) of the resin particles (the inorganic particles) and the application (spraying) of the alumina particles are performed in the separate coating booths in this embodiment, these applications may be performed in the same coating booth as a matter of course.

In this manner, buy forming the high friction layer 50, a groove caused by the gap between the end surfaces 61*a* and 61*b* of the flat plate portion 60 is not formed specifically on the joint line 80, and the gap between the end surfaces 61*a* and 61*b* is filled mainly with the alumina particles 95.

Figure 15:
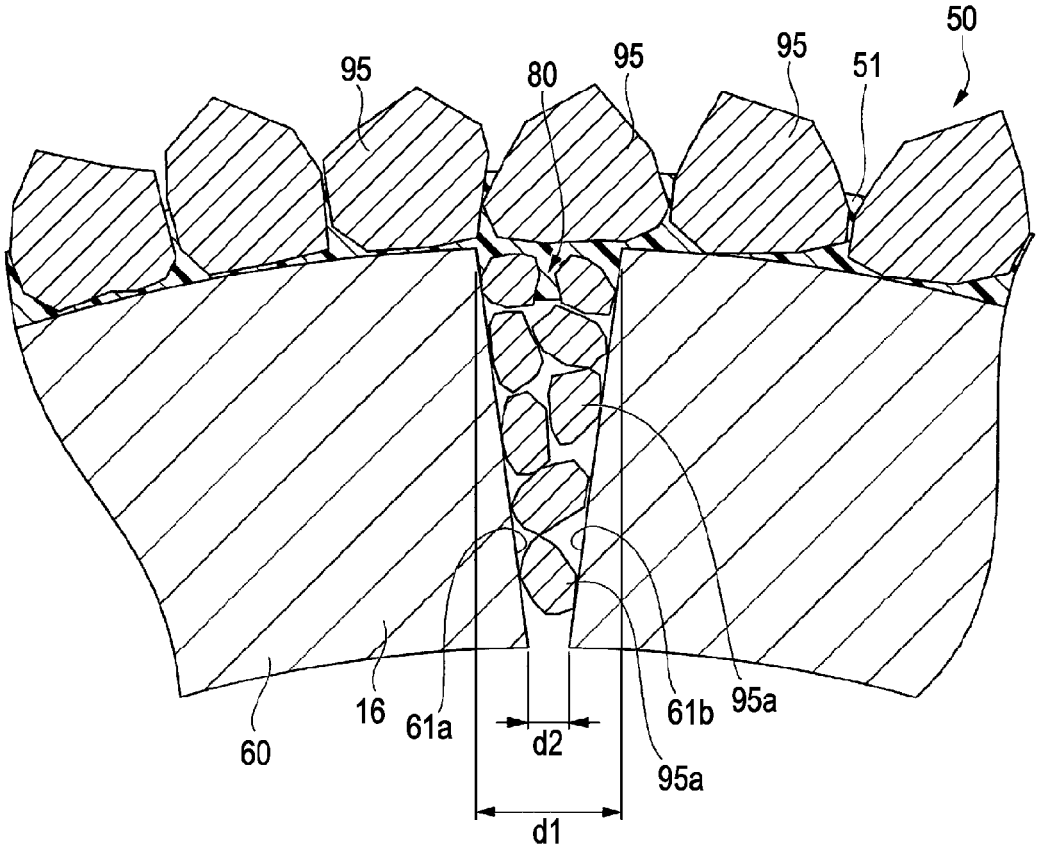
FIG. 15 is an enlarged drawing showing a principal portion of the joint line of the roller body and a portion in the vicinity thereof.

In other words, since the alumina particles 95 having the average particle diameter larger than the distance d1 of the joint line 80 on the side of the outer peripheral surface are used, most of the alumina particles are adhered on the outer peripheral surface of roller body 16 via the resin film 51 without entering the joint line 80 as shown in FIG. 15. Therefore, even though the joint line 80 is formed with the gap between the end surfaces 61*a* and 61*b* of the flat plate portion 60, the alumina particles 95 covers the gap and hence the formation of the groove caused by the gap is substantially avoided.

Since the alumina particles 95 having the particle diameter distribution (the range of granularity) including particles 95*a* having a diameter smaller than the distance d1 (30 μm) of the joint line 80 on the side of the outer peripheral surface and larger than the distance d2 (10 μm) thereof on the side of the inner peripheral surface are used, such particles 95*a* enter the gap formed on the joint line 80 and stay there, and hence the formation of the groove caused by the joint line 80 is reliably avoided.

Even when a force acts on the roller body 16 (the transporting roller 15) in the direction of reducing the gap when in use or the like, the alumina particles 95*a* entered therein resist this force, and hence the deformation of the roller body 16 (the transporting roller 15) is inhibited. Therefore, with the transporting roller mechanism 19 provided with the transporting roller 15, the unevenness of the transport caused by the deformation of the transporting roller 15 is prevented.

Furthermore, the alumina particles 95 having a minimum particle diameter in the particle diameter distribution larger than the shortest distance between the pair of the end surfaces 61*a* and 61*b* on the joint line 80, that is, the distance d2 thereof on the side of the inner peripheral surface are used. Therefore, when the high friction layer 50 is formed with the alumina particles 95 distributed on the surface of the roller body 16, the alumina particles 95 are prevented from entering the roller body 16 through the gap formed on the joint line 80. Therefore, the subsequent process of cleaning the interior of the roller body 16 or the like is reduced, and hence the productivity can be improved correspondingly.

With the steps described above, the high friction layer 50 formed of the alumina particles 95 are dispersed in and exposed from the resin film 51 as shown in FIG. 15 is formed, whereby the transporting roller 15 in this embodiment is obtained.

As described thus far, in this embodiment, the depression 65A and the projection 65B are formed on the both sides of the flat plate portion 60 in the direction of the short side when punching the metal plate M, the end surfaces 61*a* and 61*b* are brought into abutment with each other by press-fitting the projection 65B into the depression 65A to form the hook-shaped joint line 80 when forming the roller body 16 by bending. Accordingly, the deformation such that the joint line 80 opens is prevented, and the high accuracy of transport can be maintained for a long time.

After the roller body 16 has been formed by bending, the pressing force is applied to at least a predetermined portion (the recording area 15A) of the outer peripheral surface 16*a* of the roller body 16 on which the high friction layer 50 is formed, so that the stress remaining on the roller body 16 is adjusted. Therefore, the remaining stress is uniformized at least in the predetermined portion. Consequently, a change of the shape of the roller body 16 in this predetermined portion can be inhibited. Accordingly, the transporting roller 15 having a stable shape can be manufactured.

Also, according to this embodiment, the pressing force is applied over the entire surface of the outer peripheral surface 16*a* of the roller body 16 in the stress adjusting step. Therefore, the remaining stress over the entire surface of the roller body 16 is evenly adjusted. Accordingly, the shape of the entire transporting roller 15 can be stabilized.

Also, in the stress adjusting step, the pressing force is applied in sequence from the first end portion 16*f* to the second end portion 16*s* of the roller body 16. Therefore, this step can be performed without necessarily using a large-scale apparatus. When the pressing force is applied in a state in which the core member is inserted into the interior of the roller body 16 in the stress adjusting step, the deformation of the roller body 16 can be inhibited.

After such a stress adjusting step has been performed, the gear unit member 40 is mounted on one end portion 16B of the roller body 16. The press-fitting process for press-fitting the gear unit member 40 is performed with a force on the order of 30 to 40 Kgf. With the press-fitting step with such a pressure, the plastic deformation of the roller body 16 due to the buckling is avoided.

When the gear unit member 40 having the roller body 16 press-fitted thereto reaches the joint portion 65, part of the gear unit member 40 is restored and hence is brought into a state of being protruded into the opening 81 (see FIG. 3D). Accordingly, the joint portion 65 (the opening 81) engages the gear unit member 40. Therefore, the gear unit member 40 is mounted in a state of being fixed in position both in the radial direction and the axial direction with respect to the roller body 16. Since the plastic deformation of the roller body 16 caused by the press-fitting step is prevented, occurrence of the axial deflection at the time of rotation is prevented. The gear unit member 40 is fixed reliably at a predetermined position in the direction of the length of the roller body 16 by being press-fitted into the roller body 16 and being caught by and engaged with the opening 81. In addition, since the gear unit member 40 is fixed in a state of being caught by the opening 81, even when the press-fitted portion is changed with time, the press-fitted portion is preferably held by the roller body 16.

With the steps described above, the transporting roller 15 as described above can be manufactured.

The technical scope of the invention is not limited to the embodiments shown above, and modifications may be made as needed without departing the scope of the invention.

Figure 16A:
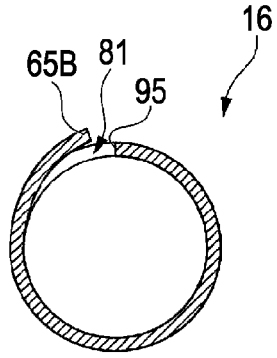
FIGS. 16A to 16C are enlarged drawings showing a principal portion of the roller body according to a modification.

In the embodiment described above, a configuration in which the roller body 16 is held by the joint portion 65 by the entry of the inner peripheral portion of the gear unit member 40 into the opening 81 has been described as an example. However, as shown in FIG. 16A, the projection 65B which constitutes the joint portion 65 may be formed to project radially outward from the outer peripheral surface of the roller body 16. In this case, the direction of rotation of the roller body 16 is matched with the direction of extension of the projection 65B.

In this configuration, when the transporting roller 15 rotates, the projection 65B projecting radially outward from the outer peripheral surface of the roller body 16 engages the inner peripheral surface of the gear unit member 40, whereby reliable engagement is achieved. Accordingly, the resistance of the gear unit member 40 against the torque can be improved.

Figure 16B:
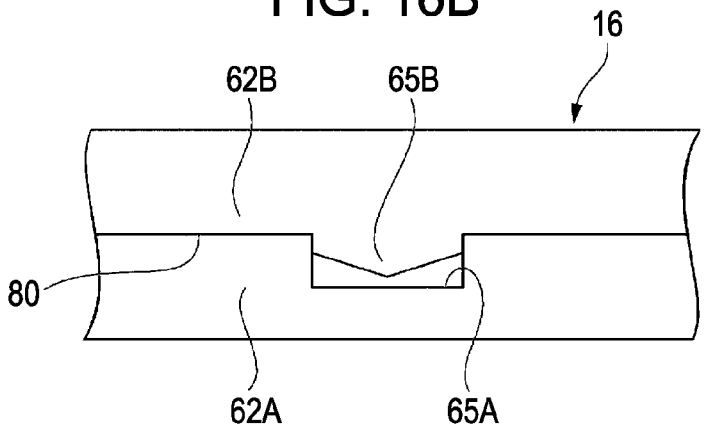
Figure 16C:
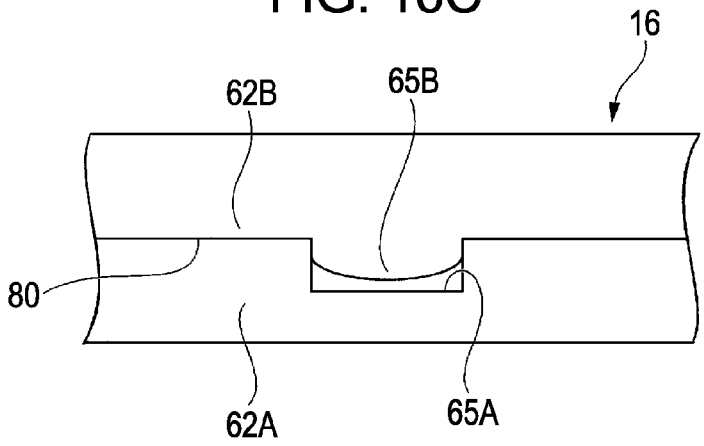

The shape of the distal end of the projection 65B is not limited to the linear shape. The shape of the distal end of the projection 65B may be formed into a triangular shape as shown in FIG. 16B or a circular shape as shown in FIG. 16C. With the projection 65B having the shape of the distal end as described above, the extent of engagement of the above-described projection 65B with the inner peripheral surface of the gear unit member 40 can be improved when the roller body 16 rotates, so that the resistance of the gear unit member 40 against the torque can further be improved.

In the embodiment described above, the roller body 16 is formed of the steel plate coil formed by winding the metal plate such as galvanized steel plate or stainless steel plate as the base material. However, the invention is not limited thereto. It is also possible to use the flat-plate-shaped metal plate as the base member, form the metal plate having the substantially same shape and same dimensions as the flat plate portion 60 from the flat-plate-shaped metal plate, and then form the roller body 16 by machining the metal plate. Therefore, a case where the flat plate portion 60 is replaced with the above-described metal plate in the explanation given above or the description given below is also applicable.

Figure 17A:
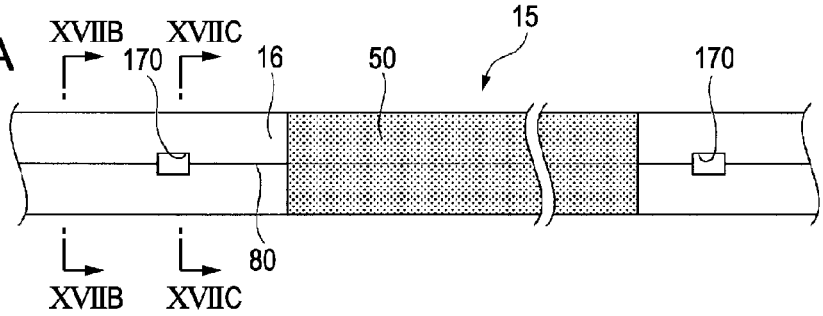
FIGS. 17A to 17D are schematic drawings showing a configuration of the roller body.

In the embodiment described above, a configuration in which the gear unit member 40 is engaged using the opening 81 of the joint portion 65 has been described. However, another opening provided on the outer peripheral portion of the roller body 16 may be used. As shown in FIG. 17A, openings 170 provided on part of the joint line 80 formed on the roller body 16 may be used as engaging portions of the gear unit member 40.

Figure 17B:
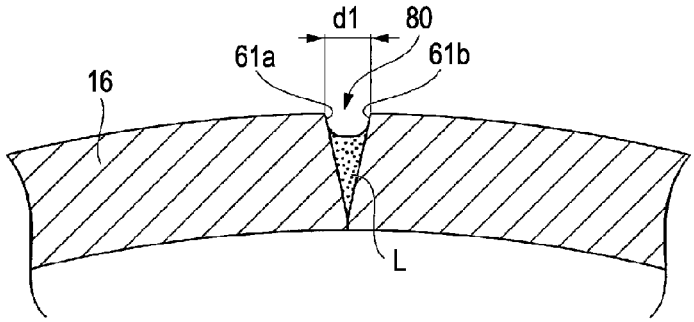

The joint line 80 formed on the roller body 16 has a groove shape in which the inner peripheral side of the pair of the end surfaces 61*a* and 61*b* are in tight contact with each other and the outer peripheral side thereof are apart from each other as shown in FIG. 17B. Alternatively, the joint line 80 may be formed in such a manner that the pair of the end surfaces 61*a* and 61*b* are not in abutment with each other and the end surfaces 61*a* and 61*b* are slightly apart from each other to form a gap. Then, since the joint line 80 is formed over the entire length of the transporting roller 15, when a grease L supplied to the bearings 26A and 26B is adhered to the surface of the transporting roller 15, the grease L runs and flows in the joint line 80 by an capillary action. In particular, in order to improve the strength of the transporting roller 15, the smaller the joint line 80 (the maximum distance d1 between the end surfaces 61*a* and 61*b*), the stronger the capillary action of the grease L becomes, so that the grease L flows easily along the joint line 80.

Figure 17C:
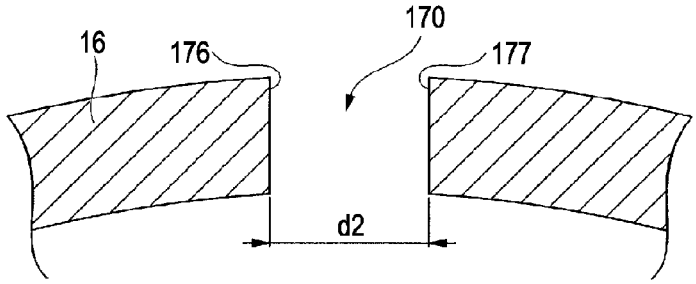

Therefore, as shown in FIG. 17C, the openings 170 are provided on parts of the joint line 80 formed on the roller body 16. The opening 170 is formed by notches 176 and 177 provided on the pair of the end surfaces 61*a* and 61*b* which form the joint line 80 as shown in FIG. 17C. The notches 176 and 177 are set to have the maximum distance d2 on the order of 1 mm or more therebetween when the end surfaces 61*a* and 61*b* are brought into abutment, and function as the opening 170.

The openings 170 are provided on the joint line 80 formed over the entire length of the transporting roller 15 (the roller body 16) except for an area where the high friction layer 50 is formed (the recording area 15A) and an area supported by the bearings 26A and 26B (the supported areas 15B and 15B). In other words, the high friction layer is formed in a substantially center portion of the transporting roller 15, and both end sides of the transporting roller 15 are supported by the bearings 26A and 26B. Therefore, at least two of the openings 170 are formed on the transporting roller 15.

In addition to the object to be used as the engaging portions of the gear unit member 40 described above, the openings 170 are capable of preventing the grease L (the lubricant) supplied (applied) to the bearings 26A and 26B from reaching the high friction layer 50 along the joint line 80 (the gap between the end surfaces 61*a* and 61*b*). In other words, by providing the openings 170 partly on the joint line 80, the capillary action of the grease L is stopped. Specifically, by providing the openings 170 between the area of the joint line 80 supported by the bearings 26A and 26B (the supported areas 15B and 15B) and the area where the high friction layer 50 is formed (the recording area 15A), the grease L is prevented from reaching the high friction layer 50. Then, by adjusting the size of the openings 170 (the maximum distance d2 between the pair of the notches 176 and 177), the capillary action of the grease L can be reliably stopped. Also, the openings 170 can hold the gear unit member 40 reliably as described above.

Figure 17D:
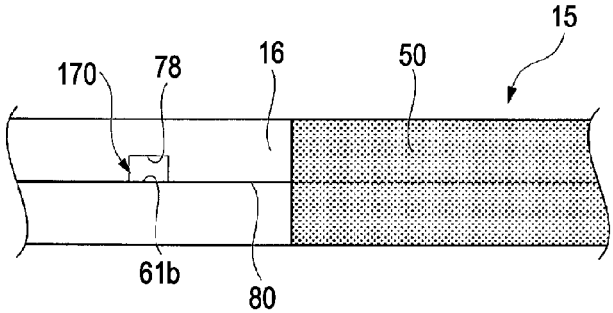

The invention is not limited to a case where the notches 176 and 177 are formed for forming the openings 170 respectively on the pair of the end surfaces 61*a* and 61*b* which form the joint line 80. In other words, as shown in FIG. 17D, a case where a notch 178 is formed only on one (the end surface 61*a*) of the pair of the end surfaces 61*a* and 61*b* which form the joint line 80 to form the opening 170 by the notch 178 and the end surface 61*b* is also applicable. The shape of the opening 170 is not limited to a rectangular shape, and may be a circular shape.

Figure 18A:
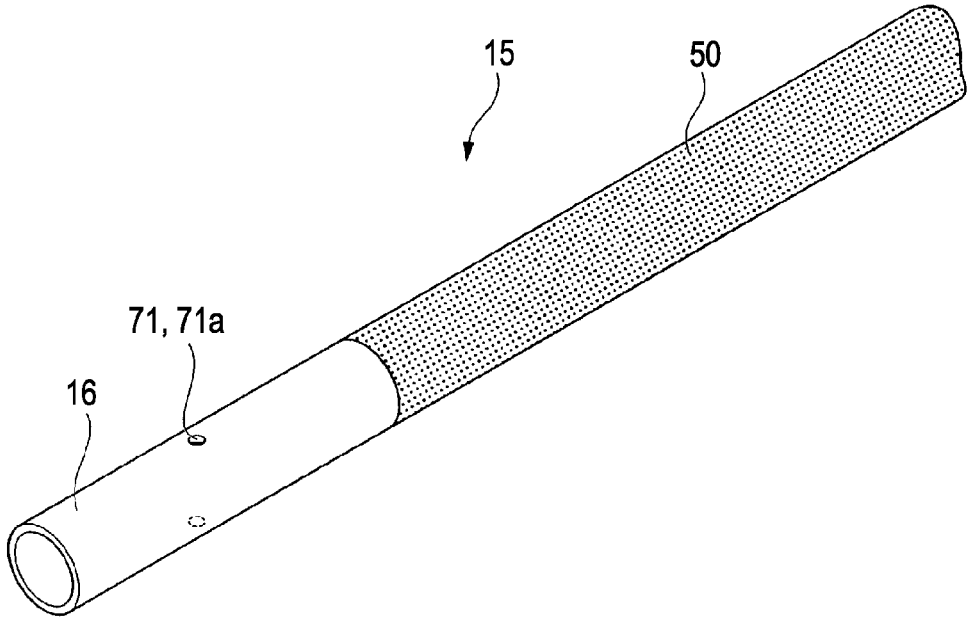
FIG. 18A is a perspective view of a principal portion of the roller body.
Figure 18B:
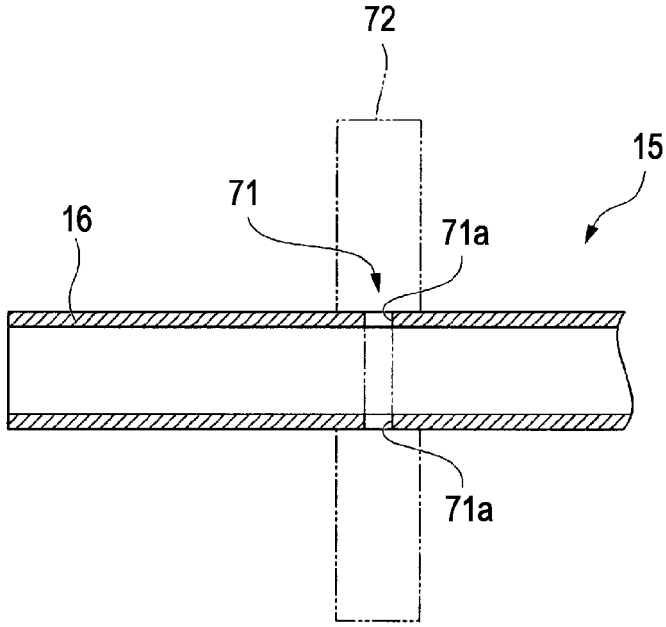
FIG. 18B is a cross-sectional view of the principal portion of the roller body.

As shown in FIGS. 18A and 18B, through holes 71*a* and 71*a* are formed respectively at opposed positions of a portion corresponding to the mounting area 15C of the roller body 16 formed of a cylindrical pipe (a hollow pipe), that is, surfaces of two points which define the diameter of the roller body 16, so that an engaging hole (the engaging portion) 71 including a pair of the through holes 71*a* and 71*a* can be formed. Formed on the inner peripheral surface of the gear unit member 40 is a projection 40*a* fitting to the engaging hole 71. In this configuration, the gear unit member 40 can be held reliably with respect to the roller body 16 by fitting (engaging) the projection 40*a* into the engaging hole 71. Accordingly, a preferable paper feeding accuracy can be obtained for a long time.

Although the preferable embodiments of the invention has been described thus far referring to the attached drawings, the invention is not limited to the embodiments described above as a matter of course. It is apparent for those skilled in the art that the invention may be improved or modified variously within the scope of technical thought described in appended claims, and these improvements or modifications are apparently included in the technical scope of the invention.

What is claimed is:

1. A printing apparatus comprising:

a transporting roller that includes a cylindrical shaft formed from a material and having a joint formed by two opposing end surfaces of the material bent and brought into abutment with each other, the joint extending between axial ends of the cylindrical shaft;

a driven roller that, together with the transporting roller, nips a recording medium and transports the recording medium;

a recording unit that records on the recording medium;

a high friction layer formed on a surface of the transporting roller and configured to come into contact with the recording medium during its transport;

wherein the joint further comprises:

a first joint section extending along the axial direction of the cylindrical shaft, and a projection provided at one axial end of the cylindrical shaft, the projection projecting in a direction crosswise to the direction of the first joint section, wherein a first spacing between opposing end surfaces in the projection is greater than a second spacing between opposing end surfaces in the first joint section;

wherein the printing apparatus further comprises:

a gear member disposed so that an inner peripheral surface of the gear member is located on the first spacing.

2. The printing apparatus according to claim 1, wherein the first spacing varies in the axial direction of the cylindrical shaft.

3. The printing apparatus according to claim 2, wherein the first spacing becomes narrower as its distance from the first joint increases.

4. The printing apparatus according to claim 1, wherein part of the projection projects radially outward from an outer peripheral surface of the transporting roller.

* * * * *